US010957144B2

(12) United States Patent
Naaman

(10) Patent No.: US 10,957,144 B2
(45) Date of Patent: Mar. 23, 2021

(54) STORING CABINET

(71) Applicant: Noam Naaman, Haifa (IL)

(72) Inventor: Noam Naaman, Haifa (IL)

( * ) Notice: Subject to any disclaimer, the term of this patent is extended or adjusted under 35 U.S.C. 154(b) by 0 days.

(21) Appl. No.: 16/480,715

(22) PCT Filed: Feb. 25, 2018

(86) PCT No.: PCT/IB2018/051173
§ 371 (c)(1),
(2) Date: Jul. 25, 2019

(87) PCT Pub. No.: WO2018/154526
PCT Pub. Date: Aug. 30, 2018

(65) Prior Publication Data

US 2019/0392667 A1 Dec. 26, 2019

Related U.S. Application Data

(60) Provisional application No. 62/463,927, filed on Feb. 27, 2017.

(51) Int. Cl.
*G07F 11/54* (2006.01)
*G07F 17/00* (2006.01)

(52) U.S. Cl.
CPC ..... *G07F 11/54* (2013.01); *G07F 17/0042* (2013.01); *G07F 17/0092* (2013.01)

(58) Field of Classification Search
CPC ..... G07F 11/54; G07F 11/004; G07F 11/48; G07F 11/50; G07F 17/0092
USPC ..... 222/144
See application file for complete search history.

(56) References Cited

U.S. PATENT DOCUMENTS 1,696,795 A * 12/1928 Cutler ..... G07F 11/54 312/97.1
1,753,248 A * 4/1930 Nutt ..... G07F 11/54 221/75
1,833,815 A * 11/1931 Beilgard ..... G07F 11/54 221/83
3,712,507 A * 1/1973 Holt ..... G07F 11/54 221/82
4,498,603 A * 2/1985 Wittenborg ..... G07F 11/54 221/120
RE32,191 E * 6/1986 Krakauer ..... G07F 11/54 221/113
4,893,727 A * 1/1990 Near ..... G07F 11/54 194/205
5,244,266 A * 9/1993 Maldanis ..... G07F 11/54 312/116
6,386,449 B1 * 5/2002 Signoretto ..... G07F 11/54 235/375
2004/0217165 A1 * 11/2004 Hayden ..... G07F 17/0042 235/381
2008/0128444 A1 * 6/2008 Schininger ..... G07F 11/54 221/3
2010/0017023 A1 * 1/2010 Jacomet ..... G07F 9/026 700/236

(Continued)

*Primary Examiner* — Benjamin R Shaw
(74) *Attorney, Agent, or Firm* — The Law Office of Joseph L. Felber

(57) ABSTRACT

A cabinet for storing items has at least one carousel rotatable about an axis of the cabinet, and each carousel has a plurality of compartments formed about the axis. The cabinet is structured to store items into the compartments or discharge items out of the compartments.

20 Claims, 25 Drawing Sheets

(56) References Cited

U.S. PATENT DOCUMENTS

| | | | | |
|---|---|---|---|---|
| 2014/0025545 | A1* | 1/2014 | Carson | G06Q 30/018 705/29 |
| 2017/0178440 | A1* | 6/2017 | Durante | G07F 11/54 |
| 2017/0316634 | A1* | 11/2017 | Umili | G07F 11/04 |
| 2020/0066085 | A1* | 2/2020 | Zhang | G07F 11/54 |

* cited by examiner

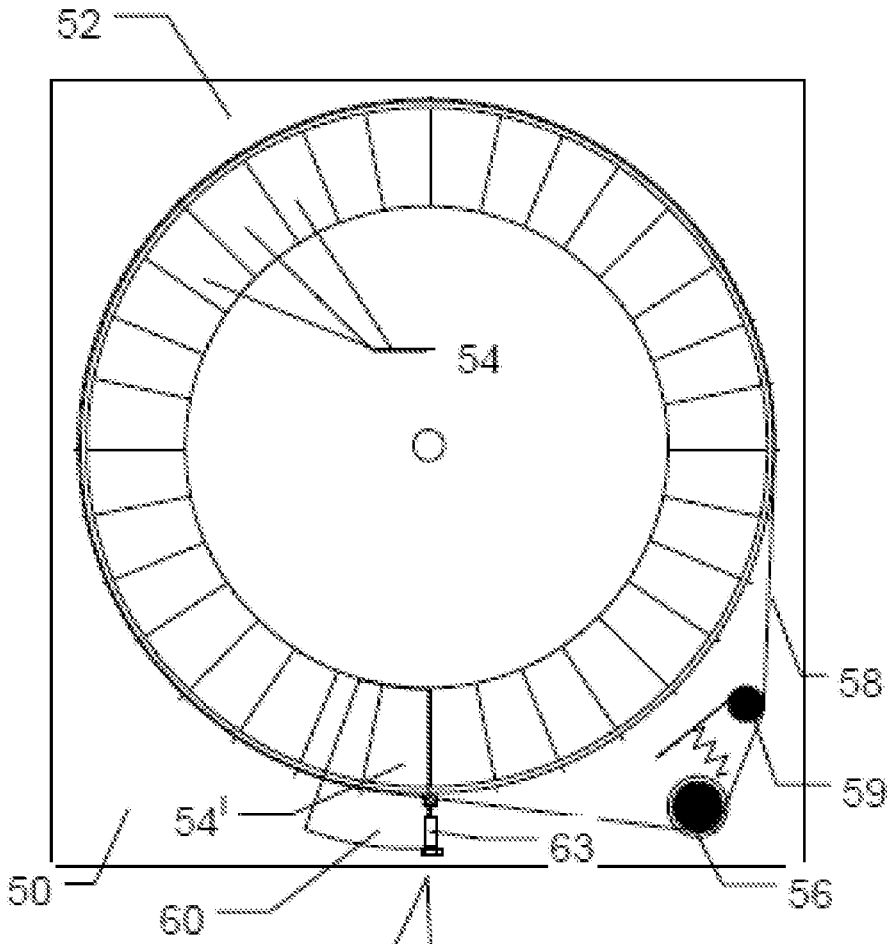
Figure 3B
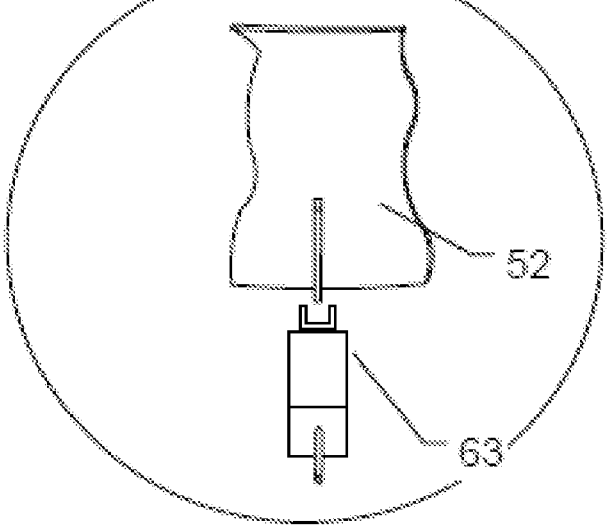

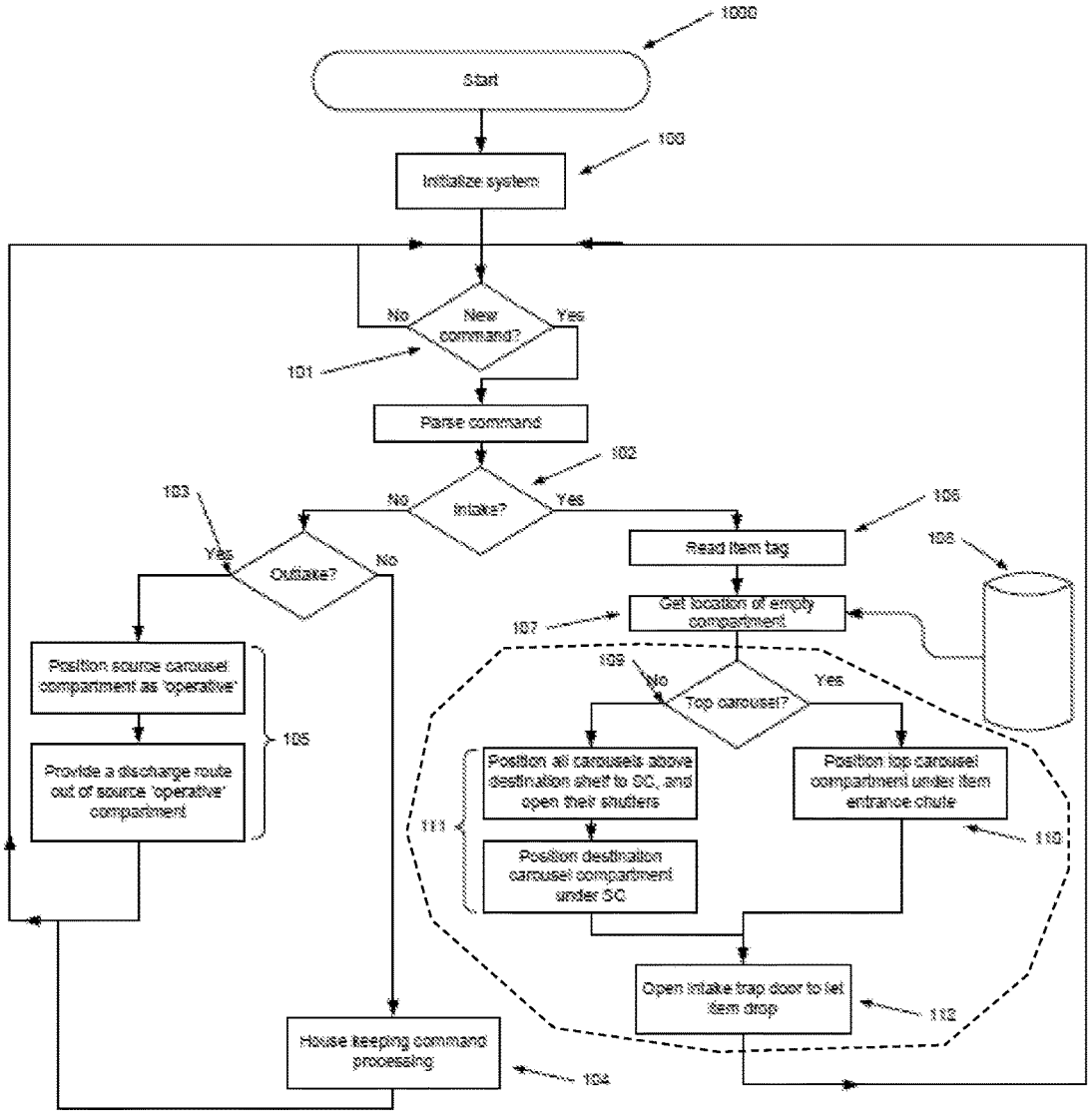
Figure 4
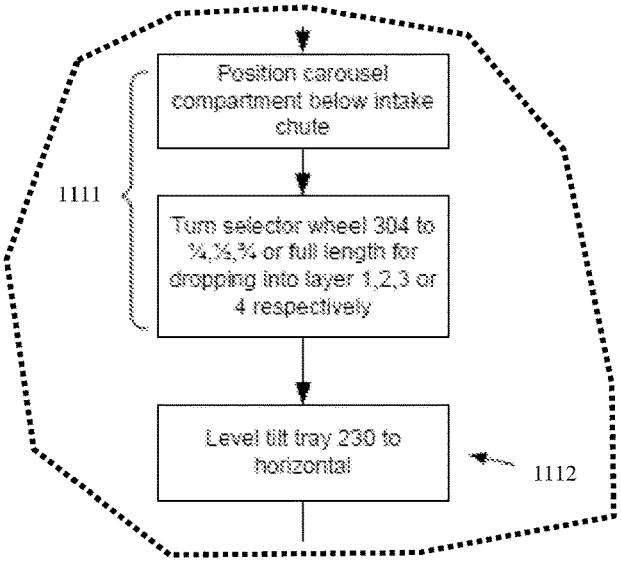

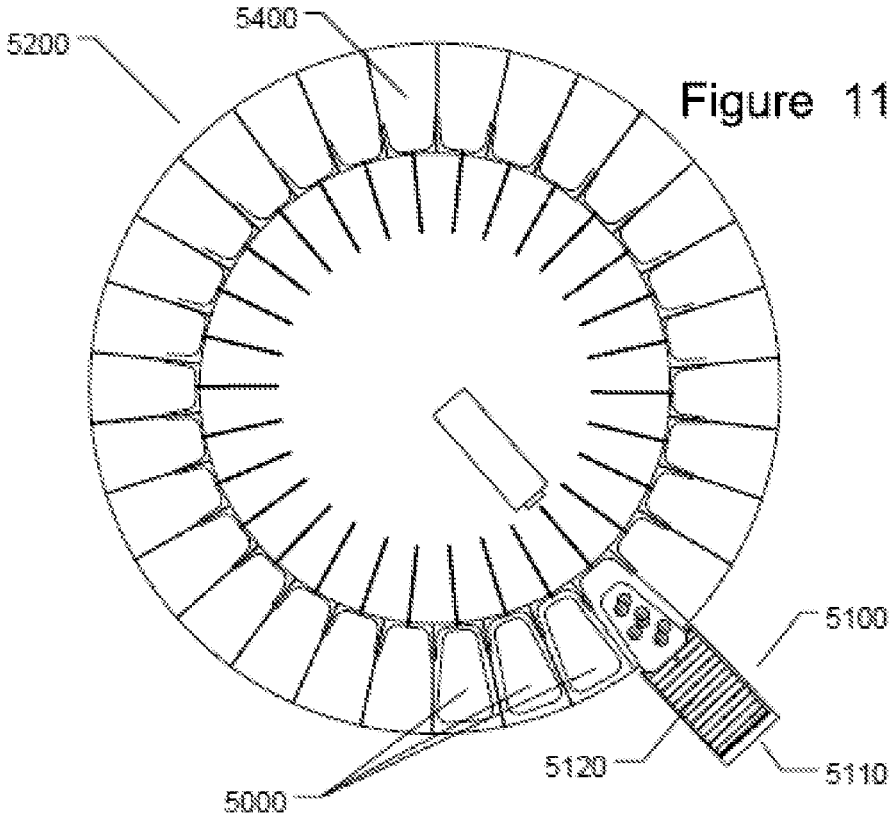
Figure 11B
Figure 11A
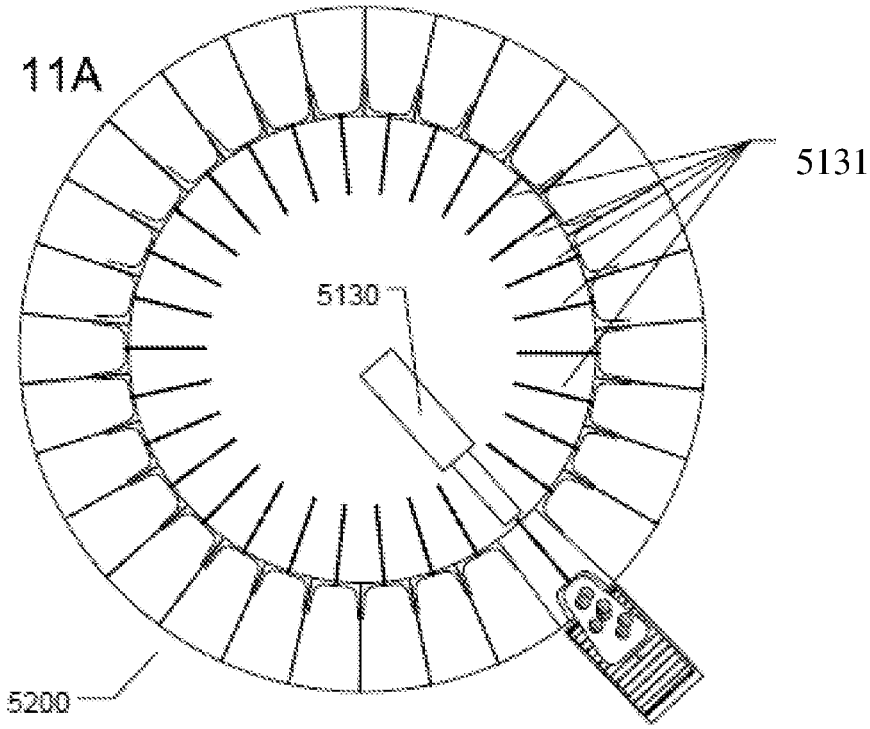

STORING CABINET

TECHNICAL FIELD

Embodiments of the present invention relate to storage in cabinets/apparatuses/dispensers, more particularly to modular, multi-compartment and/or secured storage cabinets/apparatuses/dispensers.

BACKGROUND

Storing of items e.g. in cabinets, apparatuses, dispensers (or the like) may be for various purposes, where in some cases the method and structure of storage may depend on the type of items to be stored.

US2010324728 for example describes an automatic dispenser for dispensing drugs and medications to patients. The dispenser includes a remote dispenser that transmits and receives information from a communications network and dispenses prescription drugs to the patient.

US2011014018 in another example describes a storage apparatus for packages. The apparatus has a rack of storage bins and a pick head drive unit to drive a pick head to an access location for a selected bin. Withdrawal of packages acts by dragging a desired package from the selected bin.

US2012004770 in yet another example describes a vending machine, in communication with a remote station, that delivers a labeled container to a user from storage holding containers of different sizes and shapes and containing different products such as medicaments.

Certain storing cabinets and/or storing methods may be referred to as automated storage and retrieval system (ASRS or AS/RS) that typically consist of a variety of computer-controlled systems for automatically placing and retrieving loads from defined storage locations.

Such automated storage and retrieval systems (AS/RS) are typically used in applications where there is a very high volume of loads being moved into and out of storage AS/RS systems may be designed for automated storage and retrieval of parts and items in manufacturing, distribution, retail, wholesale and institutions (or the like).

An example of other systems that may be referred to as fulfilling storage of goods may be of a type generally similar to so-called vending machines that are configured to dispense items to customers automatically, in response to action made to a customer.

The term "last mile delivery" is nowadays associated to supply chain management and relates to the last leg of transportation and/or delivery of goods to their final-destination. Such "last mile delivery" entails challenges relating, inter alia, to processing deliveries e.g. in urban areas, to retail stores, merchants (and the like).

Growth in e-commerce for example entails challenges in efficiency of "last leg of delivery" or "last block delivery" to a consumer's home or business, e.g. due to consumers often being away from home when deliveries are normally made. Some solutions to these challenges include lockers that are placed in urban centers where customers can obtain their goods.

SUMMARY

The following embodiments and aspects thereof are described and illustrated in conjunction with systems, tools and methods which are meant to be exemplary and illustrative, not limiting in scope.

In accordance with an embodiment of the invention there is provided a cabinet for storing items, the cabinet comprising at least one carousel rotatable about an axis of the cabinet, and each carousel comprising a plurality of compartments formed about the axis, wherein the cabinet is configured to store items into the compartments or discharge items out of the compartments.

Such cabinet may be any apparatus/system/means capable and/or configured of storing and/or dispensing items/articles or bin((s) including such items/articles (for example bulks of items).

It is noted that herein reference to the term item/article may also include bins including one or more items/articles. Thus, e.g. a compartment said to possibly include an item may in at least some cases also be equally understood as a compartment possibly including a bin with one or more items. Possibly, storing and/or discharging of items may comprise rotation of a carousel. This may be for purpose of urging an intended compartment where an item is to be stored to as location adapted for receiving the item and/or a location suitable for dispensing an item out of the cabinet.

In an embodiment, a cabinet or a system including a cabinet may define for each given carousel a portal sector at a fixed angular position about the axis and the given carousel is configured to rotate about the axis to position different compartments in alignment with the portal sector, and each compartment rotated into such alignment becomes an operative compartment of the carousel through which items can be discharged out of the carousel.

In an example where a carousel is located on an optional shelf, the 'portal sector' may be defined by a closable opening at a certain location through the shelf, and bringing a certain compartment of a carousel into alignment with this opening determines the compartment in such alignment as an 'operative compartment' through which item(s) stored in the compartment can be discharged out of the 'operative compartment' and consequently out of the carousel.

In an embodiment, there is provided a cabinet for storing items comprising an intake chute for receiving items to be inserted into the cabinet and an outtake bin for receiving items discharged and/or dispensed out of the cabinet,

- the cabinet comprising a plurality of carousels each independently rotatable about an axis of the cabinet, wherein the axis extends generally upright with respect to a ground face, and wherein
- each carousel comprising a plurality of compartments formed about the axis, and the cabinet is configured to store items into the compartments or discharge items out of the compartments.

Such cabinet embodiment may be referred to in the disclosure herein as a 'horizontal' storing cabinet.

In an embodiment, there is also provided a method of operating a cabinet for storing and/or discharging items comprising the steps of:

- providing a cabinet comprising at least one carousel configured for rotation about an axis, wherein the carousel comprises a plurality of compartments formed about the axis, and
- inserting an item into one of the compartments.

Possibly, the cabinet comprises an intake chute for receiving and communicating items inserted into the cabinet towards a receiving location where the item is to be received into one of the compartments, and the carousel is rotated to position an empty compartment as a receiving compartment adjacent to the receiving location.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which:

FIGS. 3*a-d* illustrate views and details of a carousel shelf incorporated in a storing cabinet in accordance with a preferred embodiment of the present invention;

FIG. 4 is a flow diagram illustrating stages by which an item is stored and discharged in accordance with an embodiment of the present invention;

FIGS. 11-14 illustrate various views of horizontal type storing cabinet embodiments of the invention;

DETAILED DESCRIPTION

Figure 1:
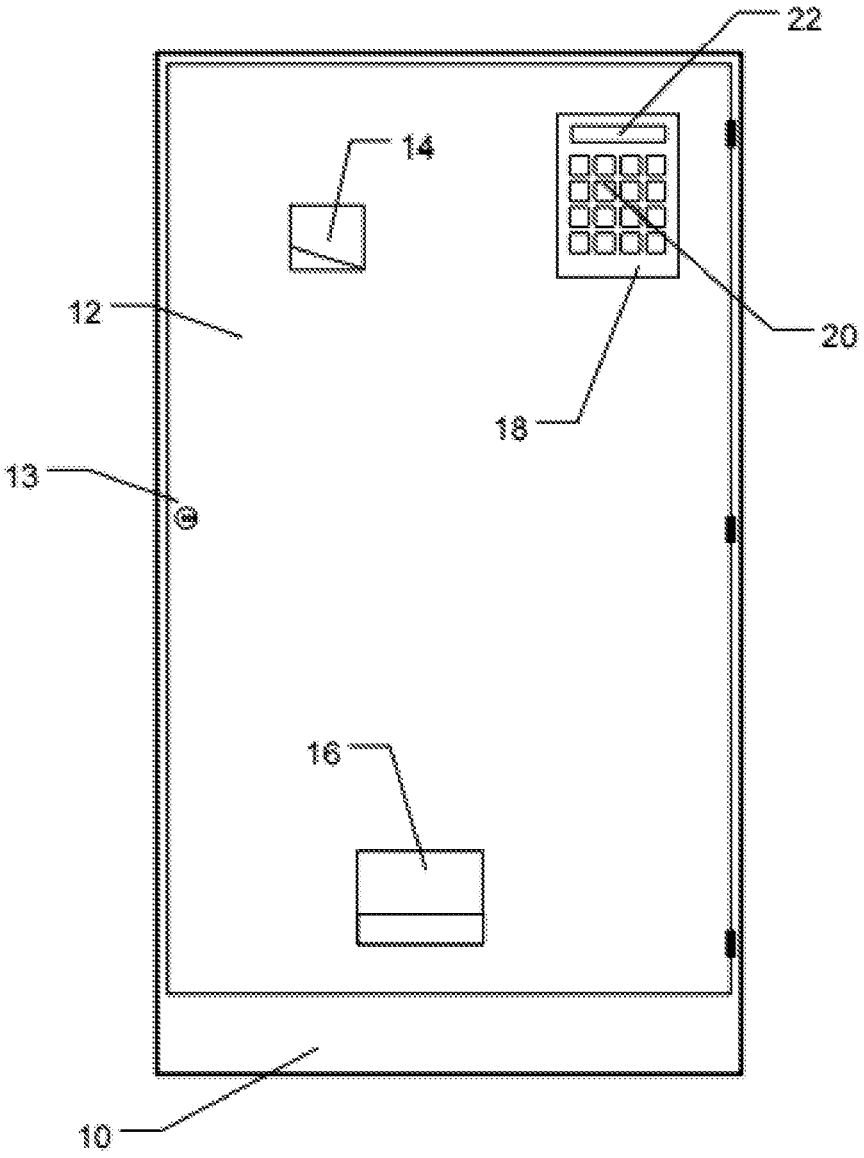
FIG. 1 illustrates a front view of a storing cabinet in accordance with an embodiment of the present invention.

In accordance with one configuration of the present invention, at least certain embodiments of a storing cabinet of the invention (see, e.g., FIG. 2) may include generally horizontally oriented carousels that are stacked one on top of the other in a vertical direction, and at least most of the carousels may have compartments for storing items, such as car keys, expensive medicines, diamonds, unique sales items, containers of bulk items, postal packages (or the like). This type configuration of a storing cabinet will be referred to herein as a 'horizontal' storing cabinet.

In accordance with another configuration of the present invention, at least certain embodiments of a storing cabinet of the invention (see, e.g., FIG. 6) may include generally vertically oriented carousels that are stacked one alongside the other in a horizontal direction, and at least most of the carousels may have compartments for storing items, such as car keys, expensive medicines, diamonds, unique sales items, containers of bulk items, postal packages (or the like). This type configuration of a storing cabinet will be referred to herein as a 'vertical' storing cabinet. In at least certain embodiments, such so-called 'horizontal' or 'vertical' storing cabinet configurations may have a modular construction permitting the addition or removal of one or more carousels so that the cabinet's storing capacity (e.g. the number of compartments and hence items/bins including items it can store) may be customized.

Such storage of items in the various configurations of storing cabinets may be in a secured manner by e.g. limiting access to a compartment once an item has been stored in it and possibly insertion or access of items into compartments and a specific carousel in the storage cabinet may be according to a pre-defined logic and/or may be in a 'random access' manner permitting direct access to a compartment where an item is to be stored or has been stored.

Such 'random access' may refer to the ability to directly access within the cabinet an item e.g. for its removal out of the cabinet without need to remove other stored items that may be in its removal path. In other words, coordinates of an item stored within the cabinet may be indexed so that the item's location is addressable, such that each item in the cabinet may be accessed roughly as easily and efficiently as any other item in the cabinet, no matter how many items may be in the cabinet.

It is noted that in the context of the present disclosure, the term cabinet refers to any apparatus and/or system capable of storing and/or dispensing items and/or bin(s) including items. Thus, this term should be understood in this general non-limiting context. In addition, such cabinet in accordance with the present disclosure may be housed in organizations, locations and/or any other required point of interest (such as in public accessible urban locations) where items stored therein may be required.

For example, a vendor of a certain product, may locate such a cabinet within a facility of a customer so that the customer upon demand may dispense out of the cabinet a required item or a bin including a bulk of such items for his use. The dispensing of items may be logged by a system associated or in communication with the cabinet so that the customer may then be later charged for the items taken.

Other examples of use of such cabinet(s), may be for dispensing articles, for example medicines or the like. For example, cabinets of at least certain embodiments of the invention may be useful, inter alia, in addressing "last mile delivery" issues/challenges by being placed e.g. in urban centers, where on the one hand goods can be fed/inserted easily/efficiently therein by suppliers and/or postal service personal—while on the other hand customers can easily/efferently obtain their goods.

Reference is made to FIG. 1 illustrating a front view of a 'horizontal' storing cabinet 10 in accordance with an embodiment of the present invention. Cabinet 10 is provided with a door 12 having a lock 13 that may be opened e.g. in cases of maintenance etc. Lock 13 may include a mechanical, electrical and/or any other type mechanism.

In at least certain embodiments, door 12 may not necessarily be opened in order to store or discharge items, but rather storing or discharging of items may be via dedicated ports provided in the door or any other part of the cabinet's housing. In the shown embodiment, storing of items may be facilitated through an intake chute 14 while discharging of the item may be facilitated through an outtake bin 16.

A specific storing location within the cabinet as already noted, may be controlled, according to a pre-defined logic and/or randomly, by a processor (not shown in the Figures) and discharging may be facilitated by a panel 18 through which a user can identify the item to be discharged by using keypad 20 to enter e.g. a code and interaction may be further facilitated via an LCD display 22.

Figure 2A:
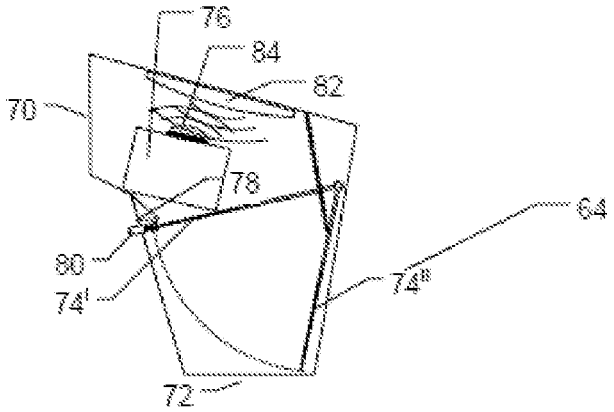
FIGS. 2*a,b* illustrate perspective and front views, respectively, of stacked carousels in a storing cabinet in accordance with an embodiment of the present invention.
Figure 2A:
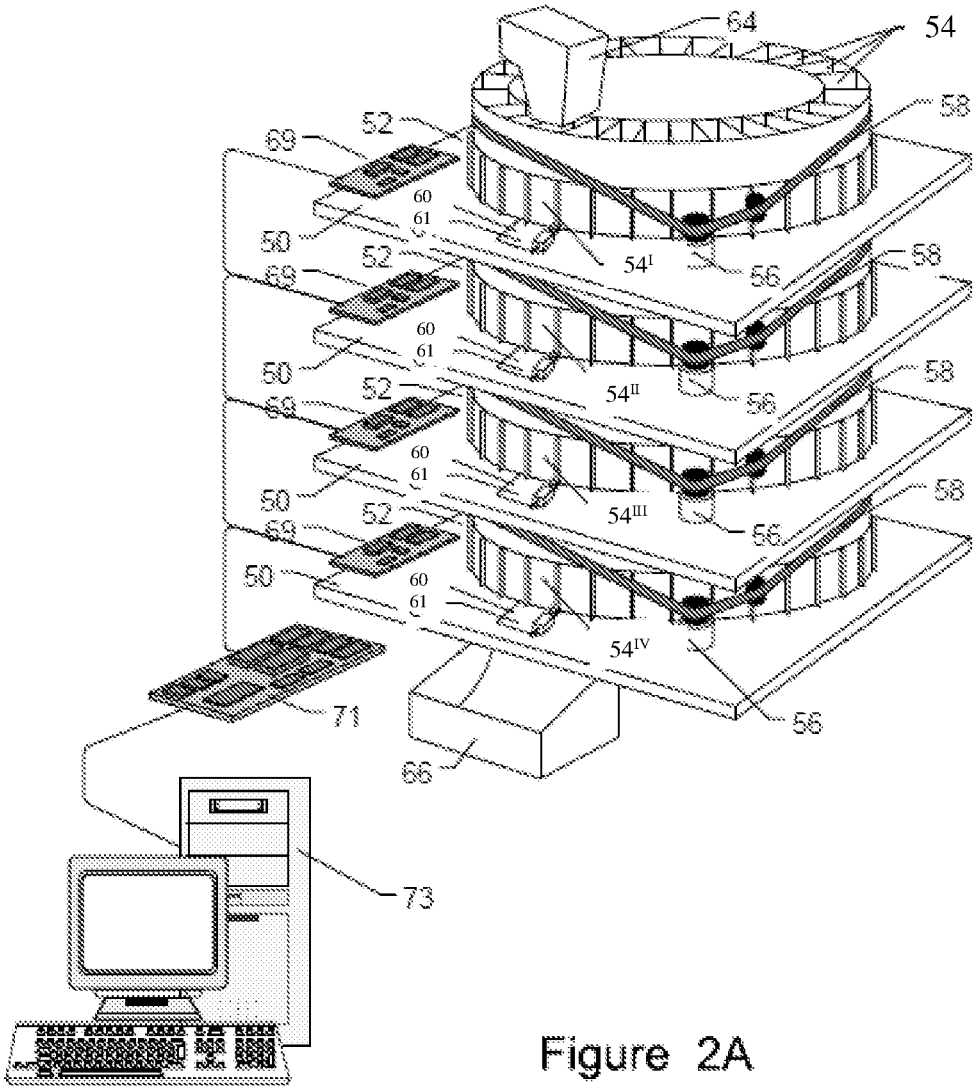
Figure 2B:
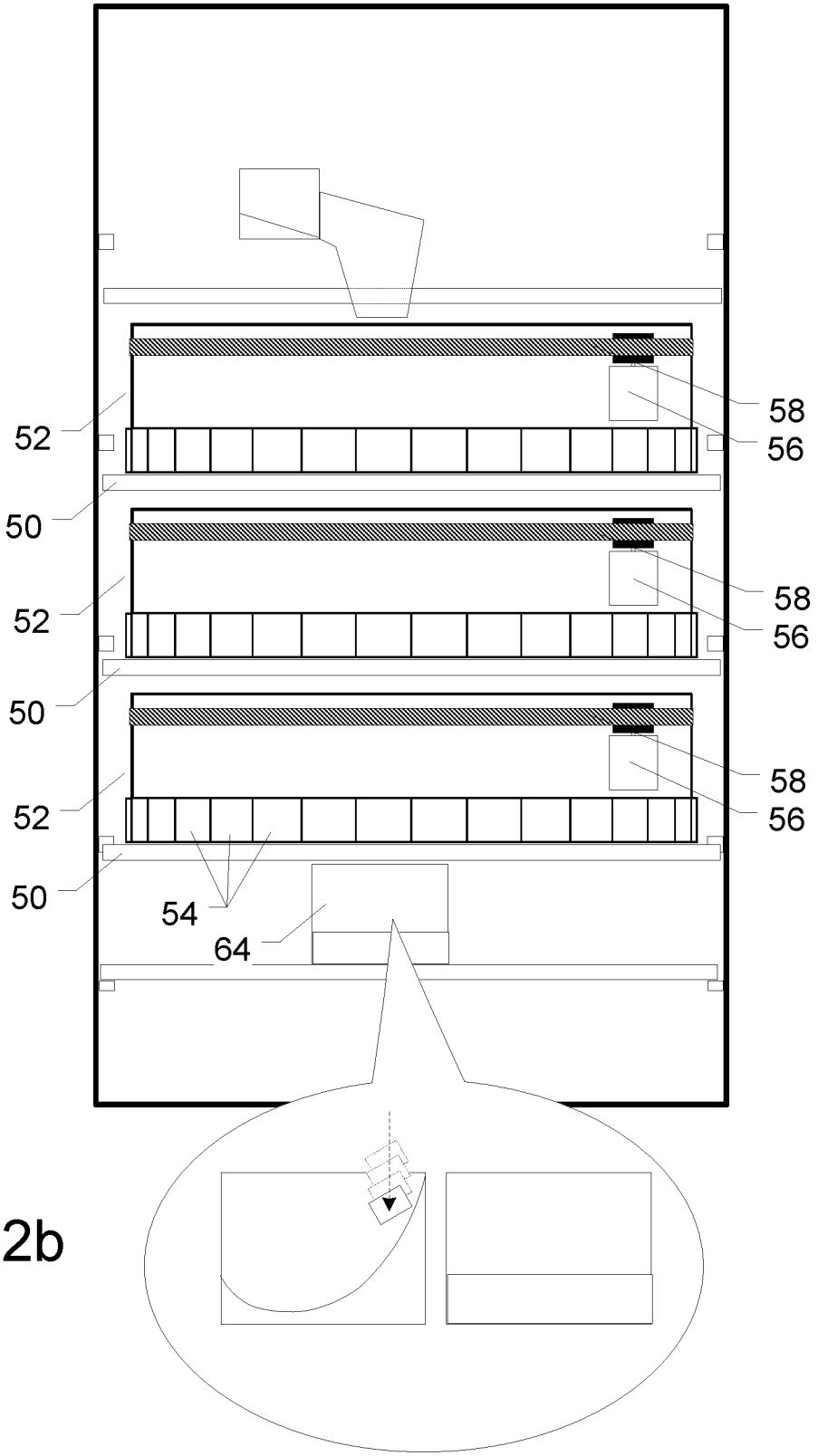

Reference is now made to FIGS. 2*a* and 2*b* illustrating possible views of an internal structure of an embodiment of a 'horizontal' storing cabinet including carousels 52 that are stacked vertically one on top of the other. The stacking may in some cases be in a modular manner and in some cases the storing of items within the cabinet may be in a 'random' and/or predefined manner. Internally, the cabinet is here shown including a plurality of shelves 50 where each shelf in this example is provided with a carousel 52 upon it. The carousels and shelves are vertically stacked one on top of the other (here e.g. in FIG. 2*a* fours such shelves and carousels are illustrated and in FIG. 2*b* e.g. three such shelves and carousels are illustrated), and each carousel is independently rotatable lending modularity characteristics to the cabinet. If necessary, an additional carousel or carousels can be added to the cabinet lending additional modularity characteristics to the cabinet.

As seen in the uppermost carousel, each carousel 52 may be divided into a plurality of compartments 54 that are preferably arranged at a radial outer circumference of the carousel. Each compartment 54 may in one example be open from both sides—the upper side and the bottom side, wherein the bottom side may be seated in this example on a shelf 50 that acts as a base that closes the lower side of compartments 54.

In this example, each carousel 52 may be provided with an independent motor 56 and a belt 58 adapted to rotate carousel 52. It should be noted however that any other mechanism adapted to rotate the carousels can be utilized; such as the mechanism seen in FIG. 9 where a motor 56 is shown that is configured to rotate a cogwheel 57. The teeth of cogwheel 57 (in the example shown in FIG. 9) in turn mesh with teeth located on a periphery of a carousel, so that by rotation of cogwheel 57 the carousel is urged to rotate.

As shown in FIG. 2*a*, each shelf 50 may be provided with at least one closable opening 60, here one opening 60, that is adapted to substantially accord the size of a bottom open side of one compartment 54. Each opening 60 is provided with a shutter 61 adapted to close and open the opening.

A compartment 54 that is located above an opening 60, e.g. in its adjacently lower located shelf, will be referred to from hereon as an 'operative' compartment, i.e. a compartment within a carousel through which items e.g. can be discharged out of the carousel. Therefore, any compartment in a certain carousel that is moved to a position above an opening will become the 'operative' compartment and an 'operative' compartment moved away from a position above an opening will cease to be referred to as 'operative'.

The shelves 50 in this example are arranged so that their openings 60 are optionally positioned one on top of the other so that when all openings are open, a vertical passage may be formed between vertically adjacent 'operative' compartments, here tagged as $\mathbf{54}^{I}$, $\mathbf{54}^{II}$, $\mathbf{54}^{III}$ and $\mathbf{54}^{IV}$ of different carousels. Practically, one can form a straight chutelike passageway in a desirable length that passes through the shelves and the carousels through one or more 'operative' compartments.

Figure 15A:
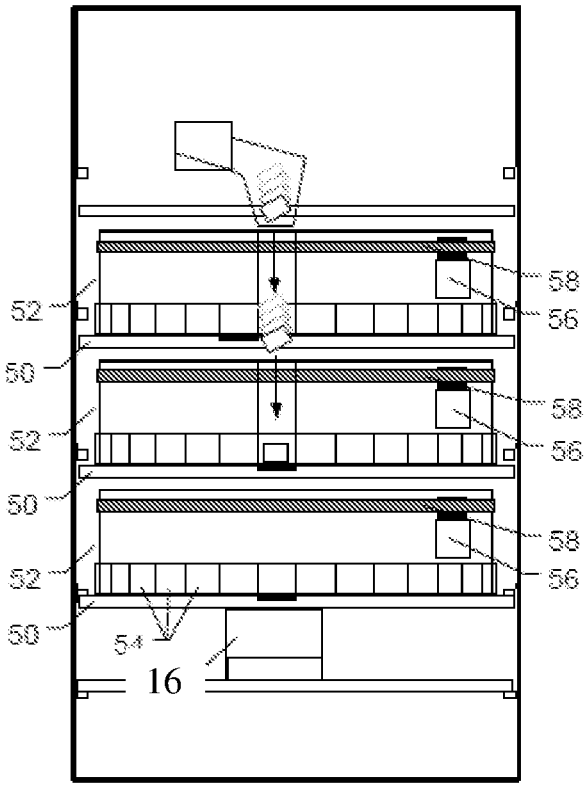
FIG. 15 illustrates various stages by which an item can be stored and discharged from an embodiment of a storing cabinet of the invention.
Figure 15B:
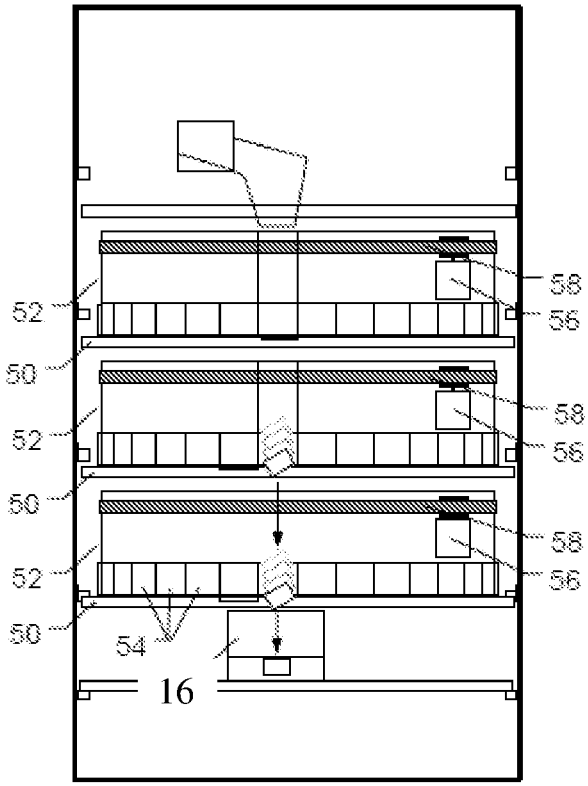

A 'horizontal' cabinet embodiment where all openings are arranged one on top of the other will be referred to herein as a straight chute (SC) cabinet, and with attention drawn to FIGS. 15A and 15B, such a straight chutelike passageway is illustrated. In FIG. 15A this straight chutelike passageway is shown for receiving an item and/or bin into a certain carousel, here the middle carousel, and in FIG. 15B for discharging an item and/bin here from the middle carousel out of the cabinet to the cabinet's outtake bin 16.

In an embodiment, the storing cabinet may be provided with an intake chute 64 above an uppermost carousel for receiving items and an outtake bin 66 beneath a lowermost carousel. An item that is dropped into the storing cabinet and passes through intake chute 64 may fall into a 'receiving' compartment that is located immediately beneath it, here being also an 'operative' compartment of the uppermost carousel marked by numeral $\mathbf{54}^{I}$.

In the case that the 'receiving' compartment is an 'operative' compartment, if the shutter 61 beneath it is in an open-state, the item placed in compartment $\mathbf{54}^{I}$ will fall downwards into a 'receiving' compartment of a lower carousel, here also being that carousel's 'operative' compartment $\mathbf{54}^{II}$. In the case of a SC cabinet embodiment where all 'operative' compartments are located one on top of the other, the downward fall of the item may continue until it is placed on top of a shelf having its shutter 61 closed and hence in a certain carousel's compartment. Rotating a carousel where the item is placed will move and/or drag the item so as to place it in a desirable and known position within the cabinet.

At least in certain embodiments, one compartment in each carousel may be left free and empty of items to allow forming a passage between the shelves (and carousels). In an embodiment of the invention, access to a specific compartment may be in a 'random access' manner and/or may be predetermined by a user, so as to in which compartment an item will be placed.

In order to discharge a specific stored item, the specific carousel where the item is stored is rotated so that the compartment storing the item becomes an 'operative' compartment that is on top of the opening 60 of the shelf. A chute can then be arranged beneath the 'operative' compartment where the item is stored so as to allow the item to drop downwards and, e.g. in a SC cabinet embodiment, if all 'operative' compartments beneath are empty and with their openings in an open state, the item can fall downwards all the way into outtake bin 66. An item dropped into outtake bin 66 can be observed in the enlargement side view of the bin at the bottom of FIG. 2*b*.

The system can be computerized and can be controlled by a computer 73 that may be, possibly electronically, in communicating through a controller 71 with each one of the carousels, where each carousel may be provided with an individual controller 69. Administrating the system can be performed using a cellular phone, a remote control device (or the like). Examples, of such administrating may include maintenance to item location database, managing item insertion (storing) and discharge (outtake), giving orders to electronic systems within the cabinet, providing reports, etc.

Reference is made again to FIG. 2*a* showing at its upper side an enlarged cross sectional view of intake chute 64.

Intake chute ma have an upper opening 70 through which items can be inserted and a bottom opening 72 mounted on top of the uppermost carousel (mounting can be observed in main FIG. 2*a*).

Intake chute 64 may be provided with a shutter 74 adapted to move, possibly in a resilient manner, between two positions: a first position (marked as 74$^{I}$) where the shutter blocks the chute and forces an item 76 to delay before passing through the chute so as to allow the item to possibly be sensed; and a second position (marked by 74$^{II}$) where the shutter allows passage of item 76 through the intake chute 64. Shutter 74 is adapted to move between the positions possibly using a spring 78 and may be adapted to be held in the first position (marked as 74$^{I}$) by a stopper 80.

Intake chute 64 may further be provided with a reader 82, possibly a proximity reader, adapted to sense an item 76 passing through upper opening 70 while item 76 may be provided with a tag 84, possibly proximity tag, adapted to be detected by reader 82, possibly by transmitting a signal to reader 82. Reader 82 in one example may be an RFID reader that can identify the item according to the information provided on transponder 84. RFID proximity tag 84 can be of a passive type through which only identification is performed; however, it can also be of a read/write type that can collect information for surveillance purposes. It is noted that other possibilities may also be envisioned for reading/identifying an item passing through chute 64, such as 1D or 2D bar code labels, color pattern labels (and the like).

Optionally, a sensor can be provided that indicates that an item is being inserted within the intake chute. This indication may start a process of storing the item in accordance e.g. with the exemplary process/algorithm explained herein below with reference to FIG. 4.

Figure 3A:
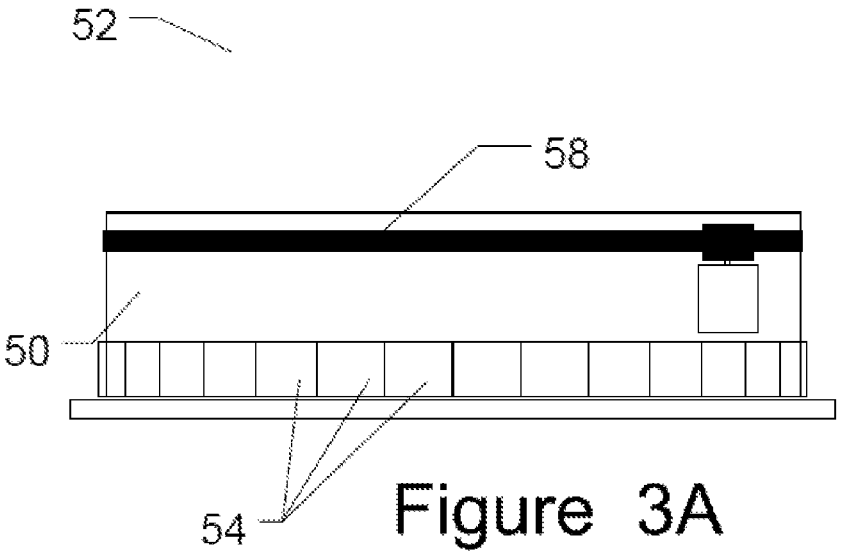

Reference is now made to FIGS. 3*a-d* illustrating views and details of a carousel shelf incorporated in a storing cabinet in accordance with an embodiment of the present invention. FIG. 3*a-d* illustrate, inter alia, a possible mechanism by which each carousel may be rotated and a possible mechanism by which the closable opening in each shelf may open and close. FIG. 3*a* illustrates a side view of a carousel 52 having a plurality of compartments 54 and a shelf 50 upon which the carousel is located.

Figure 9:
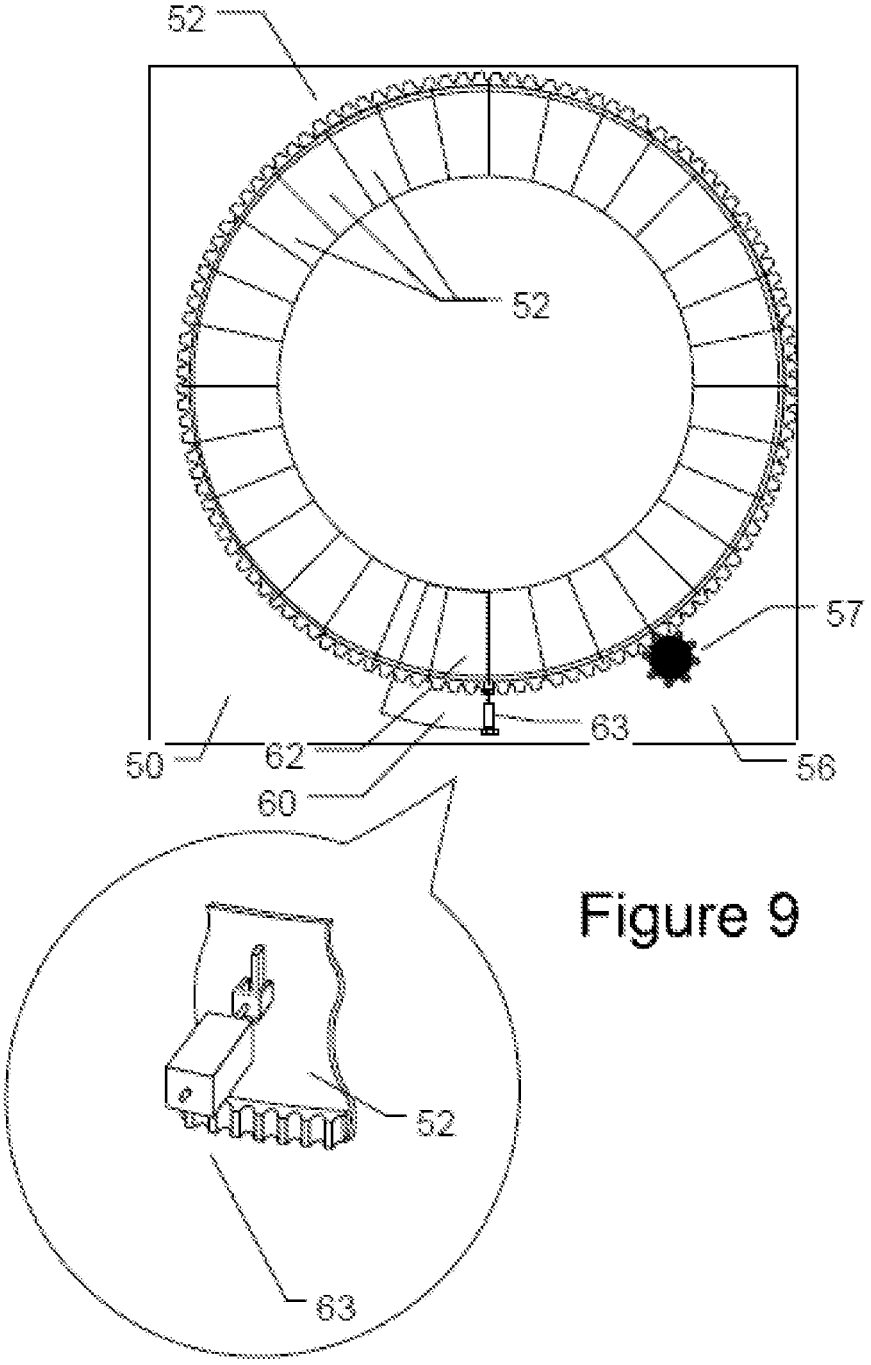
FIGS. 9,10 illustrate details of elements possibly implemented in various type storing cabinet embodiments of the invention.

A motor 56 may be provided to rotate carousel 52 possibly by using a belt 58, however other means may be provided for rotating a carousel such as the means discussed with respect to FIG. 9. In an upper view of, e.g. an uppermost carousel 52 of a cabinet, as shown in FIG. 3*b*, the different compartments 54 are clearly observed located at an outer radial periphery of the carousel. The rotational mechanism may further be provided with a tensioning member 59 adapted to render efficiency to the rotational movement of the carousel in this possible embodiment utilizing belt 58.

The compartments may be numbered or in any other way classified in order to identify any given compartment in a carousel and hence an item located within the compartment. In at least certain embodiments of the invention, in each carousel at least one compartment may be selected to be an 'empty' compartment that remains empty of items during use of the cabinet. The 'empty' compartment may possibly be a predetermined compartment, in this example the carousel's 'operative' compartment tagged 54$^{I}$.

When in each one of the carousels of a SC cabinet, the 'empty' compartment is positioned on top of its associated opening 60, (hence making it an 'operative' compartment) a vertically extending (possibly open) passageway (i.e. straight chute) may be established through the cabinet between the intake chute and the outtake bin of the cabinet.

Figure 3D:
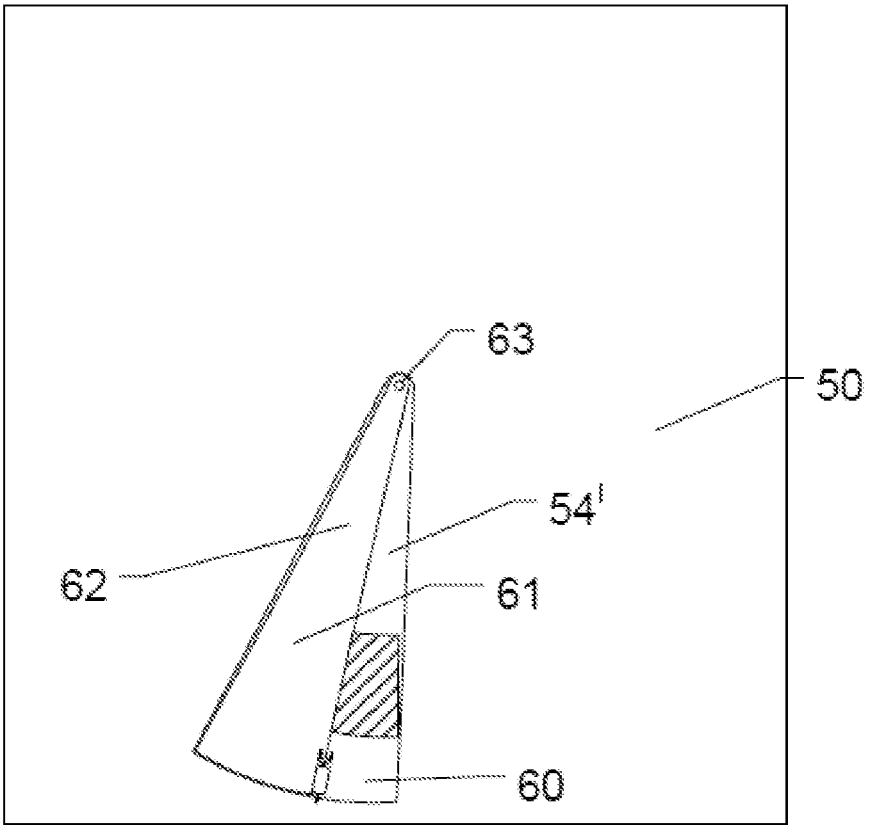

FIG. 3*d* illustrates a bottom view of shelf 50. Opening 60 in the shelf is provided with a shutter 61 that is pivotally connected here substantially in the center of shelf 50 to a pivot pin 63. Rotational movement of shutter 61 about pivot pin 63 exposes opening 60 in shelf 50 and enables a passage out of compartment 54$^{I}$ of the carousel.

Figure 3C:
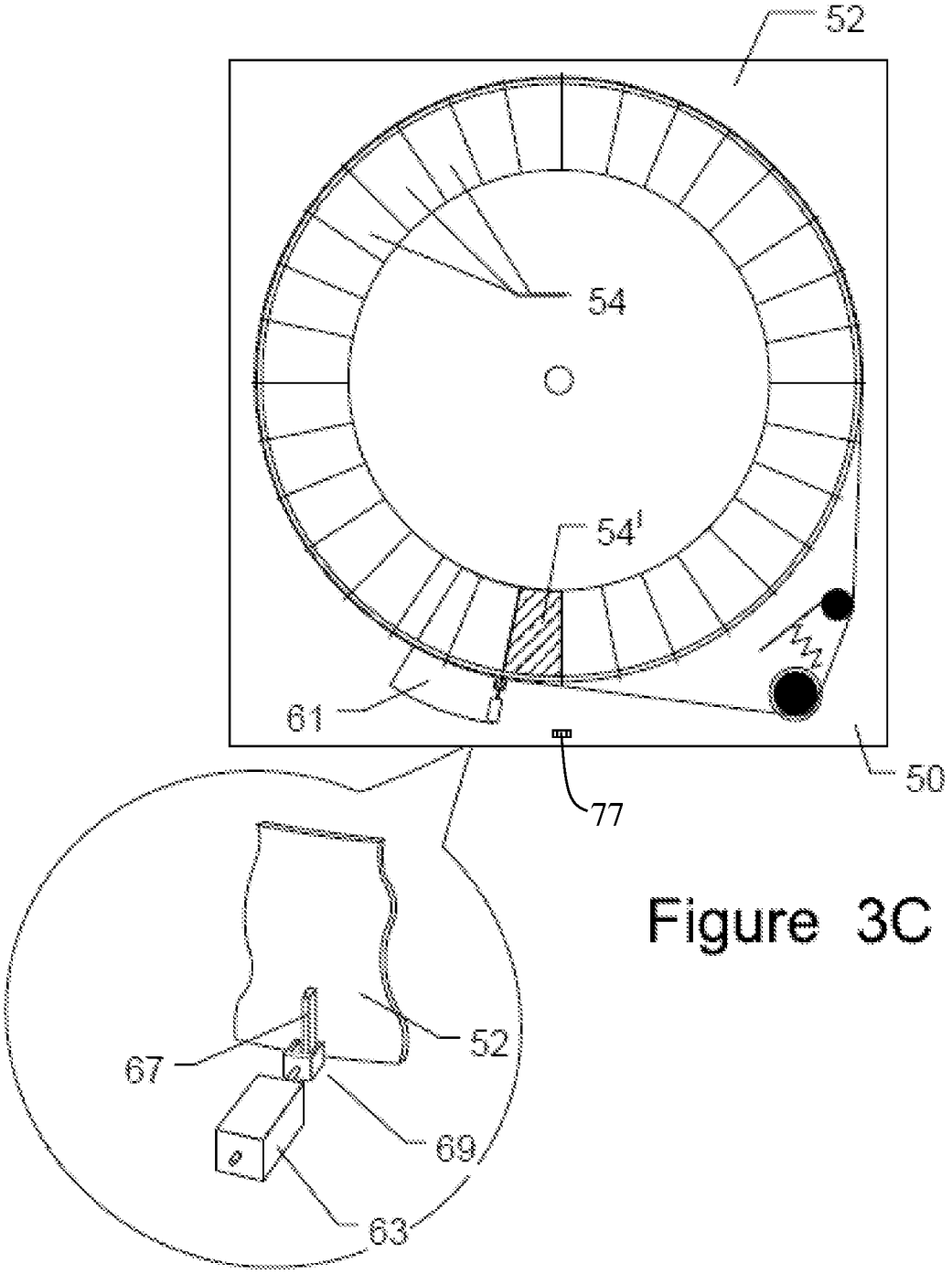

FIG. 3*c* illustrates an upper view of carousel 52 when shutter 61 is in an open position as opposed to the partial closed position of the shutter shown in FIG. 3*b*. A possible mechanism of opening and closing shutter 61 may be provided by a solenoid 63 that is mounted on shutter 61. A detailed illustration of the solenoid is provided in an enlarged isometric view in FIGS. 3*b* and 3*c*.

Compartments 54 of carousel 52 may be separated by a wall having a protrusion 67 that protrudes beyond the carousel's outer peripheral wall. Solenoid 63 may be provided with a gripper 69 adapted to move between two positions: a first position (shown in FIG. 3*c*) where gripper 69 grips protrusion 67 so as to allow shutter 61 to facilitate opening and closing and a second position where gripper 69 is retracted (shown in FIG. 3*b*) and solenoid 63 is independent of the carousel.

Shutter in this example is moved by engaging the solenoid toward the carousel and causing the carousel to rotate clockwise or counterclockwise. The carousel then drags the shutter when gripper 69 is in contact with protrusion 67 to accordingly open or close the shutter. It should be emphasized that any other mechanism adapted to open and close shutter 61 can be employed in the cabinet of the present invention.

In order to secure the opening in a closed position when necessary, it is optional to provide a locking hole 77 in shelf 50. When shutter 61 is closed, it is secured to locking hole 77. When shutter 61 is about to be open, it is being released out of locking hole 77 so as to allow the shutter to open. Securing the shutter to locking hole 77 may be performed by the solenoid tail, when in idle mode, being configured to be caught by hole 77, in order to prevent shutter 60 from being dragged open accidentally by rotating items moving on top of it.

Figure 5:
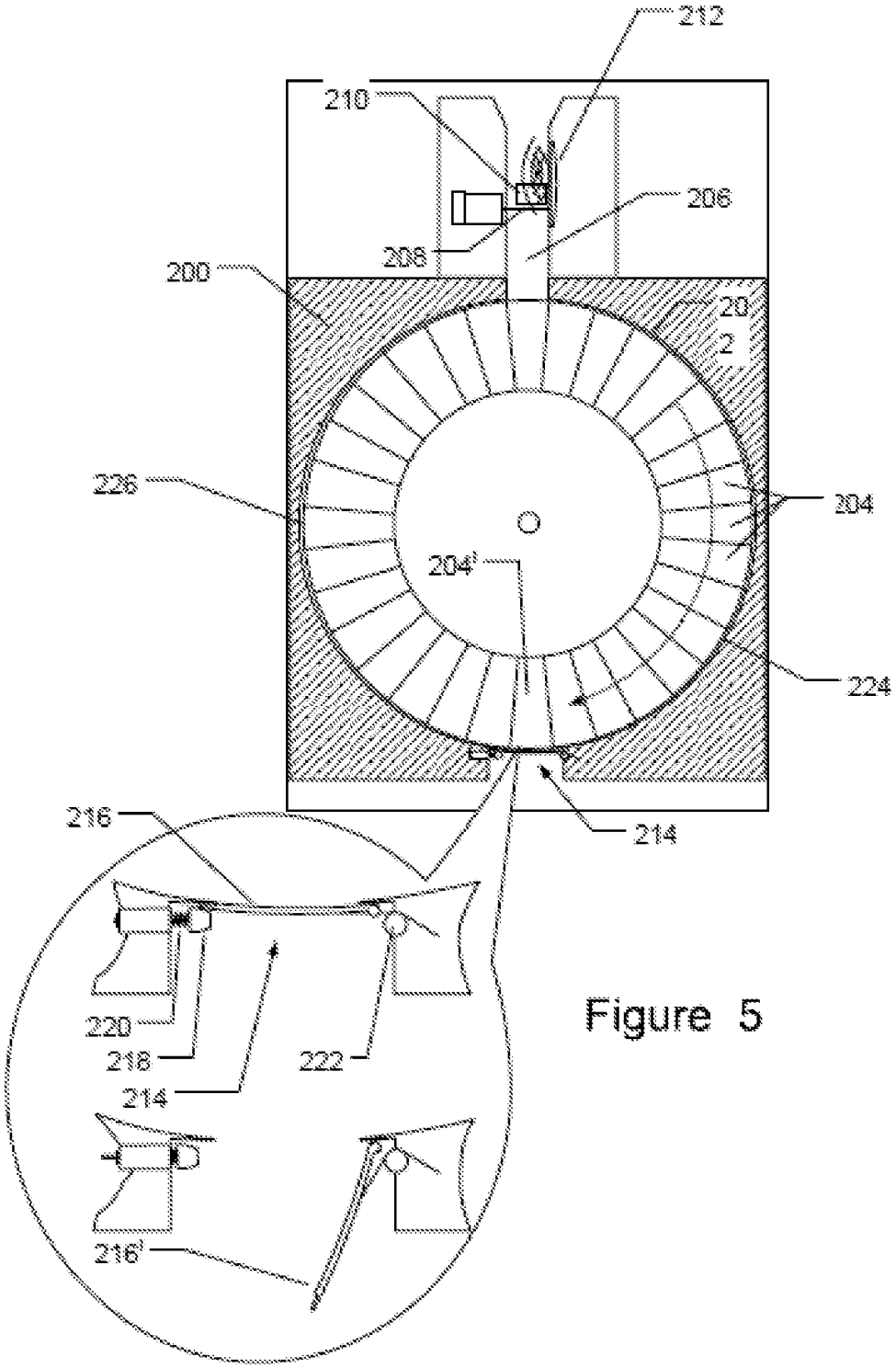
FIG. 5 illustrates a frontal view of a vertical storing cabinet in accordance with another embodiment of the present invention.

Reference is now made to FIG. 5 illustrating a frontal view of a 'vertical' storing cabinet 200 in accordance with an embodiment of the present invention. Storage cabinet 200 comprises a vertically arranged carousel 202 having a plurality of compartments 204 preferably arranged in the circumference of the carousel. Cabinet 200 further comprises an intake chute 206 provided with a shutter 208 adapted to delay an item 210 so as to enable the system to start operating the storage by identifying item 210 using e.g. an RFID reader 212 and/or sensing it similarly to the principles explained herein before in the 'horizontal' cabinet arrangement.

Intake chute 206 may be positioned in a relative upper side of the carousel, possibly at the uppermost position on top of carousel 202; and a compartment within a carousel where an item is intended to be stored should be made a 'receiving' compartment of its carousel (i.e. located beneath intake chute 206) by rotating its respective carousel.

An outtake shutter 214 may be provided at a relative lower location beneath carousel 202 so as to allow a discharge route for a stored item out of carousel 202. A possible shutter mechanism is shown in an enlargement view at a lower side of FIG. 5 wherein a shutter 216 may be configured to move between two positions: in the first position, the shutter closes the compartment that is on top of the shutter and is held in place by a resiliently movable stopper 218.

Stopper 218 is adapted to withdraw from its position using a spring 220 that is loaded upon an order to discharge the item in the compartment.

Withdrawal of stopper 218 as shown in the lower part of the enlargement of FIG. 5, releases shutter 216 to a second position indicated by the numeral 216$^{I}$; being an open position permitting access to an 'operative' compartment 204' of the carousel that located immediately above the (now open) shutter and in communication with it and/or with an exit path created by the opening of the shutter. Shutter 216 may be resiliently movable by a resilient hinge 222, e.g., to at least partially urge shutter 216 towards its first closed position.

It should be noted that the compartments of a carousel of a 'vertical' cabinet embodiment may have a radially outward open side and sidewalls 224 and 226 of the cabinet in such case may be provided so as to secure the items, e.g., so that they do not fall out when an open side of such a compartment faces generally downwards (as, e.g., in the case of 'operative' compartment 204'). The sidewalls 224 and 226 in this example are not rotated together with the carousel.

According to a possible method of the present invention, an item that is dropped into a 'vertical' cabinet embodiment through its intake chute may possibly be identified and then stored in a selected one of the compartments of one of the cabinet's carousels. The selected compartment where the item is configured to be stored may be advanced to a position where it becomes momentarily a 'receiving' compartment of its carousel, by rotation of its respective carousel until the selected compartment is in a position beneath the intake chute. In the shown example, this position is when the receiving compartment is at an uppermost position of its carousel. In one embodiment, for any item that is dropped into the intake chute and stored in a selected compartment, a user may receive a notice, via e.g. a display, as to the positioning of the item within the cabinet and/or a coded notice indicating this position.

When a user wishes to discharge the stored item, he/she may order the system, via e.g. a keypad, to discharge the item and the system then rotates to bring the predetermined compartment to a position above the outtake shutter where that compartment becomes an 'operative' compartment of its respective carousel. By then opening a path out of the 'operative' compartment, e.g. by opening the shutter, discharge of the item out of the 'operative' compartment may be facilitated. A possible controller of the system may be updated during the whole process.

Figure 6A:
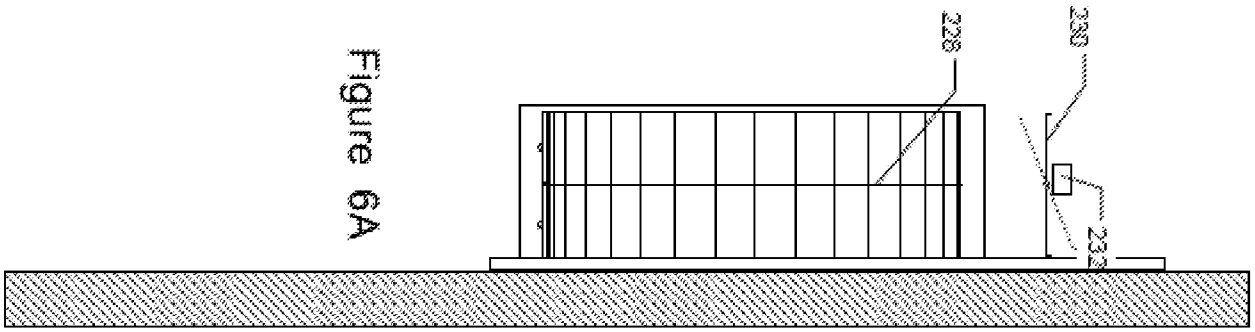
FIGS. 6*a,b* illustrate side exploded views, respectively, of a vertical storing cabinet in accordance with yet another embodiment of the present invention.
Figure 6B:
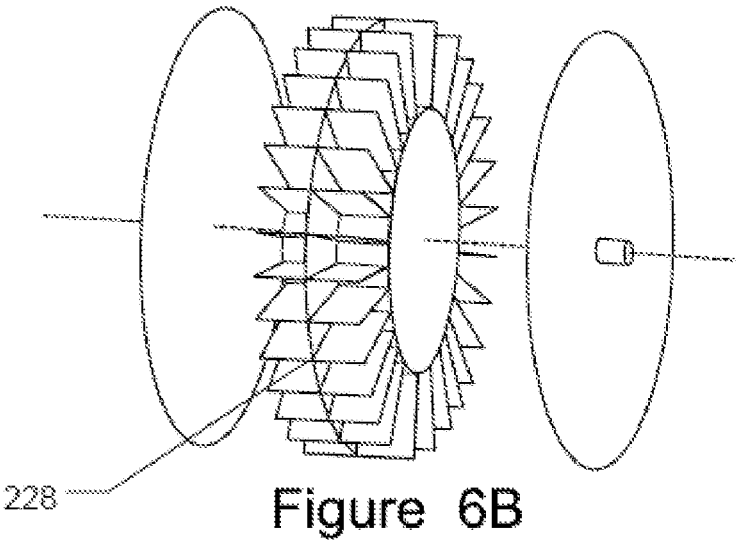

Reference is now made to FIGS. 6A and 6B illustrating, respectively, side and a perspective exploded views of a 'vertical' storing cabinet in accordance with an embodiment of the present invention. In order to increase the number of compartments without increasing the diameter of the carousel and/or decreasing the size of the compartments, an embodiment of a carousel of the invention can be provided with a divider 228 that doubles the number of compartments. In this embodiment, the intake chute may be provided with a rotatable shutter 230 that rotates between the two sides of the carousel in order to allow an item 232 to drop into a compartment in the left hand side or the right hand side of the carousel.

In order to increase the modularity of the 'vertical' arranged storage cabinet, additional carousels can be added.

Figure 7A:
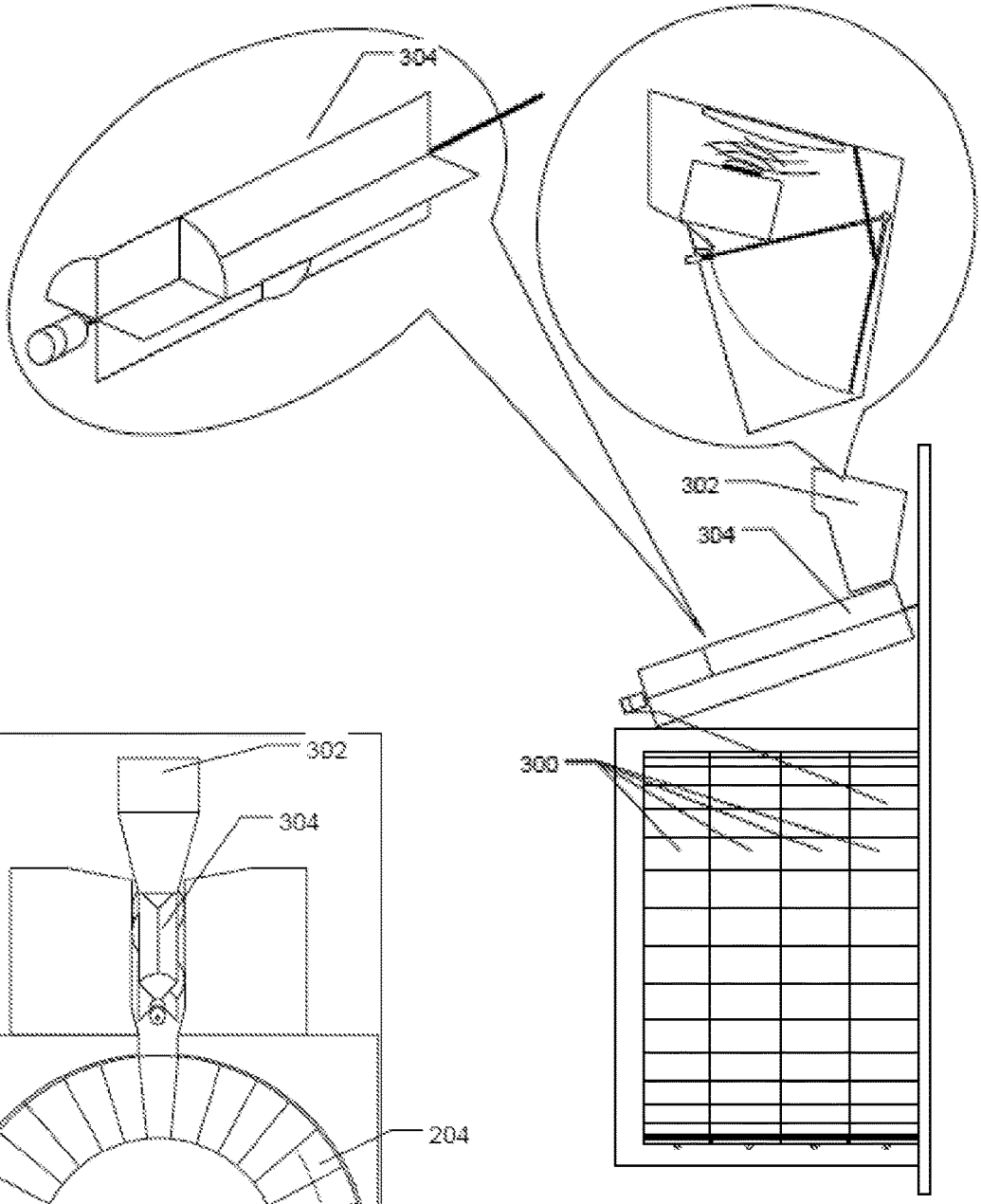
FIGS. 7*a,b* illustrate views of a vertical storage cabinet in accordance with an embodiment of the present invention.
Figure 7B:
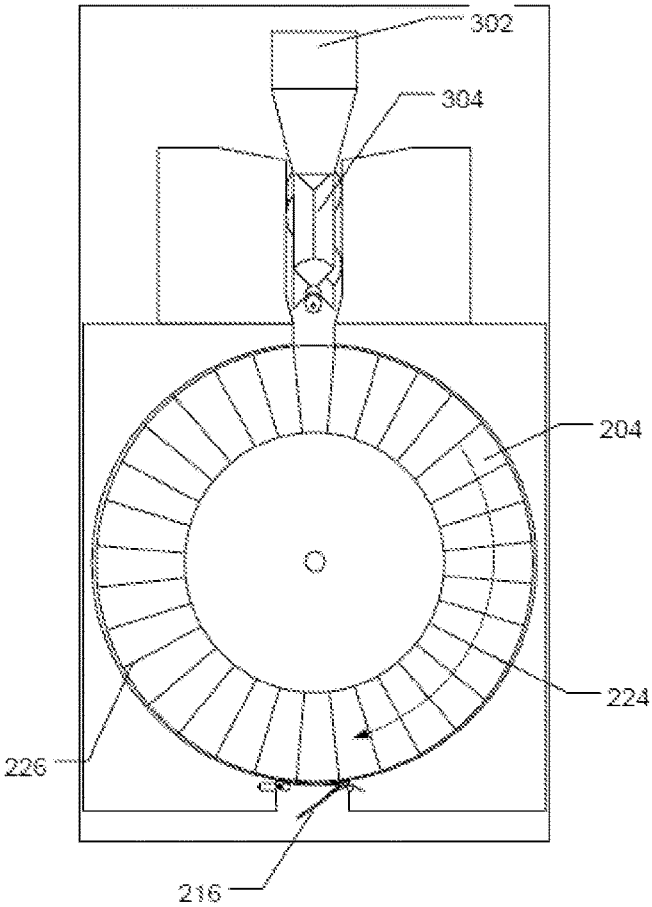

Reference is now made to FIGS. 7A and 7B illustrating different side views of a 'vertical' storage cabinet in accordance with an additional embodiment of the present invention. FIG. 7A schematically shows four vertical carousels 300 that may be provided in order to further increase the number of compartments of a 'vertical' cabinet. An intake chute 302 provided on top of carousels 300 may be provided with a selector 304 adapted to select in which one of the carousels an item will be stored. An enlarged view of the selector is indicated at the upper left enlargement. A frontal side view of the cabinet is shown in FIG. 7B.

It should be noted that each carousel or each double carousel can be independently operable and rotatable. However, all the carousels or part of them can be rotated together.

Figure 8C:
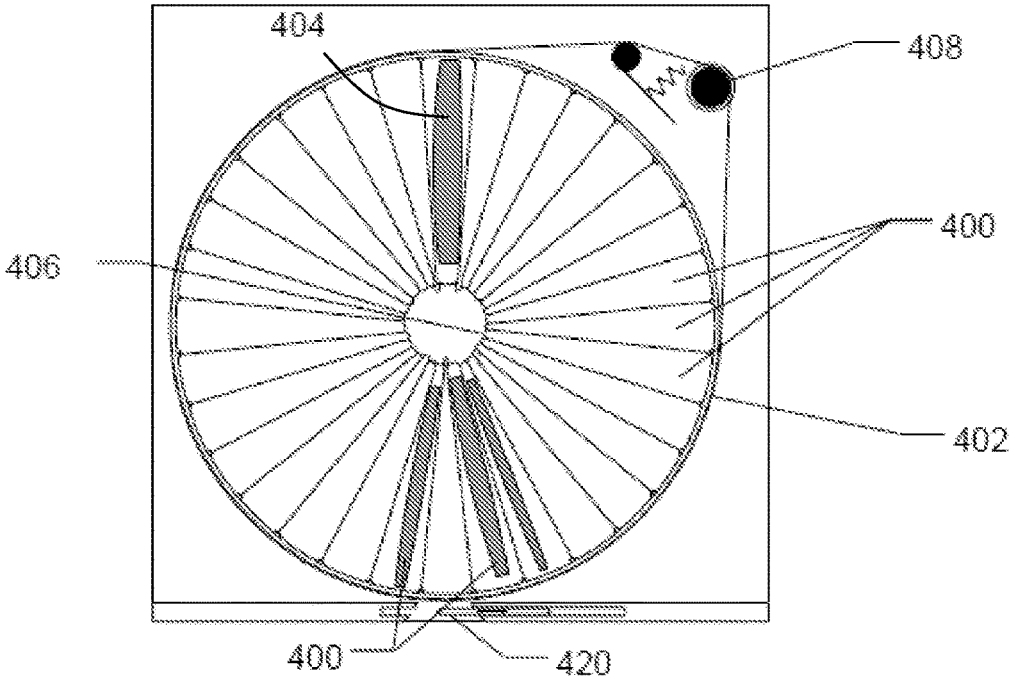
FIGS. 8*a-c* illustrate various views of a vertical storage cabinet in accordance with an embodiment of the present invention.
Figure 8B:
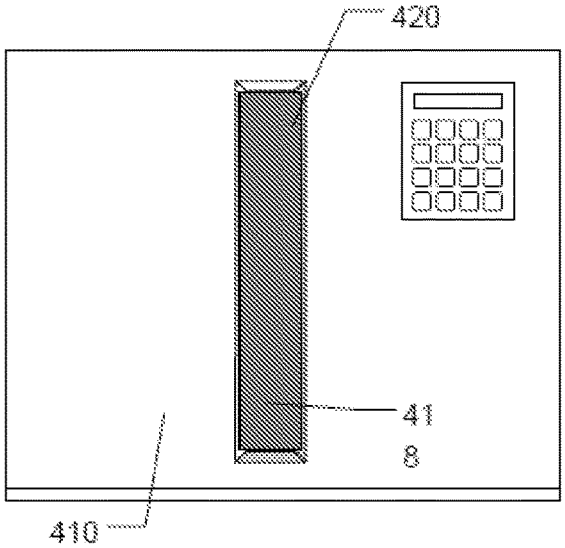
Figure 8A:
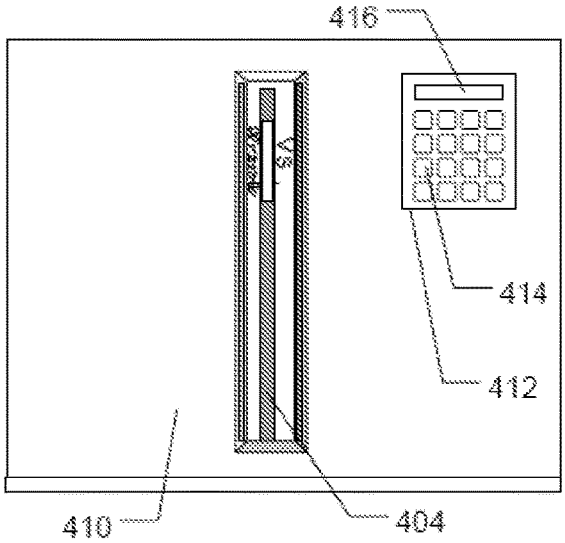

Reference is now made to FIGS. 8A to 8C illustrating a 'vertical' cabinet in accordance with an embodiment of the present invention. This embodiment is basically similar to the embodiment shown in FIGS. 5-7, however may be modified in order to accord a specific application in which the cabinet may be adapted e.g. to function as filing cabinet. In this case, compartments 400 of a carousel 402 are designed in a size that accords a standard folder 404. Since a thickness of the folders may vary according to the material that it is filed with, an interior peripheral wall 406 defining a radial inner border of each compartment in carousel 402 may be formed flexible.

It is noted that besides paper folders, other similar type shaped items of a general rectangular cuboid shape may be stored within such a cabinet, such as computer laptops or the like.

Carousel 402 may be adapted to rotate using motor 408 similarly to as already explained herein before.

FIGS. 8A and 8B illustrate frontal side views of 'vertical' cabinet 410 within which a carousel such as 402 may be located. FIG. 8B illustrates a closed state and FIG. 8A an open state of the cabinet, respectively. A user may interact with this 'vertical' storing cabinet through a panel 412 provided with a keypad 414 through which the user can deliver instructions to the controller of the system and a display, preferably an LCD display 416, through which the user receives data. A shutter 420 may be provided in the cabinet's opening, wherein the shutter is open when the user wishes to insert an article into the cabinet such as folder 404 or take the article out of the cabinet, wherein the shutter may be configured to close afterwards.

It should be mentioned that the system may be controlled by a computer or a controller so as to allow access to the compartments in a 'random access' manner.

Figure 10:
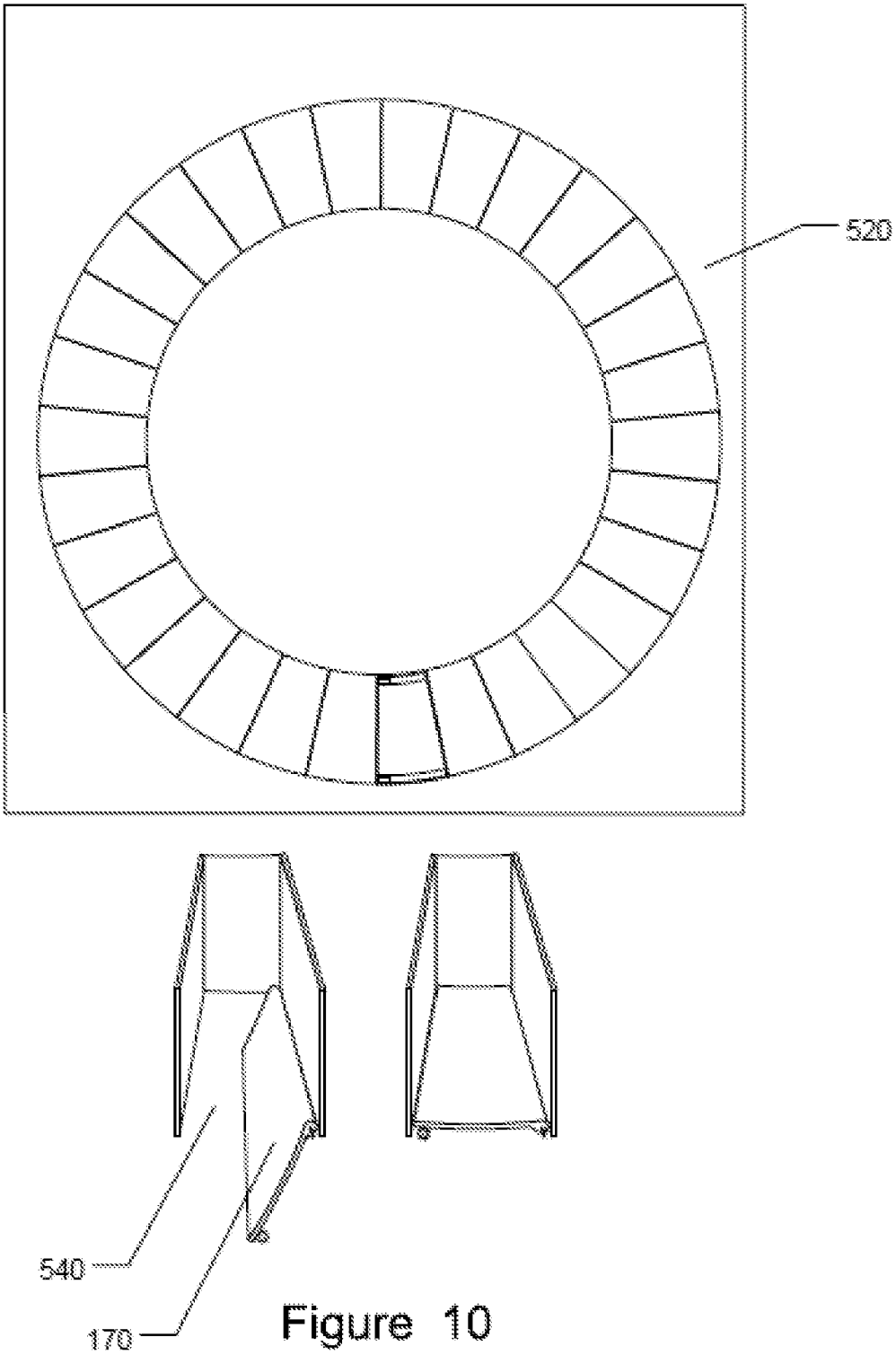

Attention is drawn to FIG. 10 illustrating an embodiment of a carousel 520 configured for use in a 'horizontal' storing cabinet embodiment of the invention. Carousel 520 may be generally similar to carousel 52 (schematically illustrated in FIGS. 3*b* and 3*c*) besides having a movable doorway 170 located beneath each compartment 540 of the carousel—so that items stored within the compartments are not dragged along e.g. a base upon which the carousel seats while the carousel rotates to permit access to specific compartments.

Attention is drawn to FIGS. 11A and 11B illustrating a further embodiment of a carousel 5200 configured for use in a 'horizontal' storing cabinet embodiment of the invention. Carousel 5200 has compartments 5400 generally similar to e.g. carousels 52 or 520—and in this embodiment a possibility is shown where each compartment 5400 may be configured to house an optional carrying bin (or container) 5000 that may include one or more items to be stored. Use of such bins in compartments may be applicable also to previously discussed carousels, such as carousels 52 or 520. It is additionally noted that carousel 5200 may also be used without such bins for storing items in its compartments as in former discussed carousels such as carousels 52 and 520.

In a 'horizontal' storing cabinet including such carousels 5200, transition between vertically stacked carousels may be facilitated by a vertically movable elevator 5100 located radially outward of the carousel. Elevator 5100 may include a cage 5110 and a belt 5120 configured to facilitate urging of items and/or bins including items out of and into the compartments of the carousel 5200. A plurality of optional pushing forks 5131, each one being associated to a respective one of the compartments, may be provided within the carousel to facilitate urging of items and/or bins including items out of the compartments. Each fork 5131 may be located at a radial inner side of its respective compartment and a pusher 5130 provided within the carousel may be configured upon activation to bear against a pushing fork associated with an 'operative' compartment of the carousel that is located opposite the elevator 5100.

Figure 12:
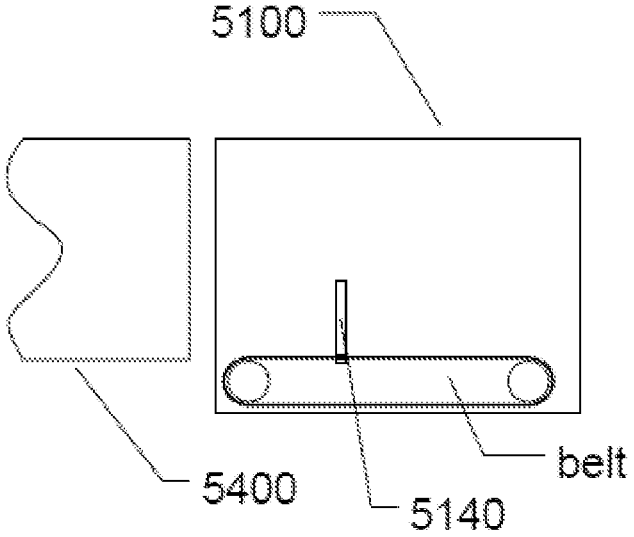

Attention is additionally drawn to FIG. 12. One or more items and/or a bin including one or more items, located within an 'operative' compartment positioned in between pusher 5130 and elevator 5100; may be urged out of the 'operative' compartment by the pusher. Elevator 5100 may include a rod 5140 fixed to the belt 5120 that may be involved in urging item(s) or bin(s) back into a compartment if required.

Figure 13A:
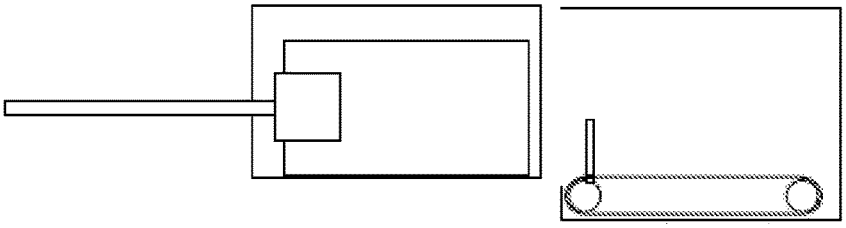
Figure 13B:
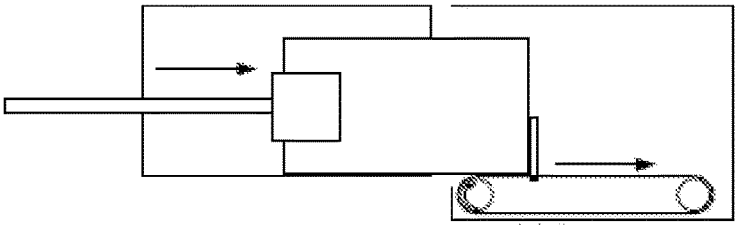

Attention is drawn to FIGS. 13A to 13E illustrating possible sequences of events that may occur during removal or entry, of items and/or bins including items, between an 'operative' compartment and an elevator of a carousel generally similar to carousel 5200. In FIG. 13A pushing fork is shown first engaging here a bin in an 'operative' compartment and in FIG. 13B the bin is shown being urged out of the 'operative' compartment (by an outward directed force applied by pusher) until it meets a rod fitted to the elevator's belt.

Figure 13C:
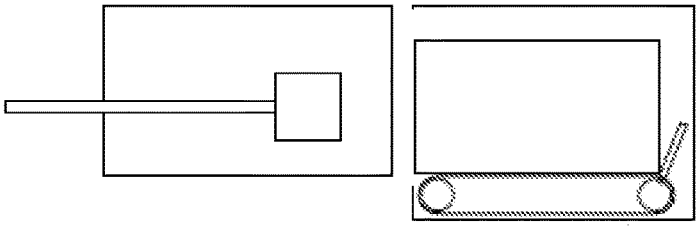
Figure 13D:
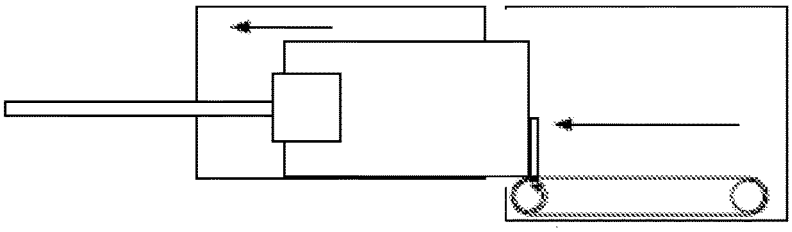
Figure 13E:
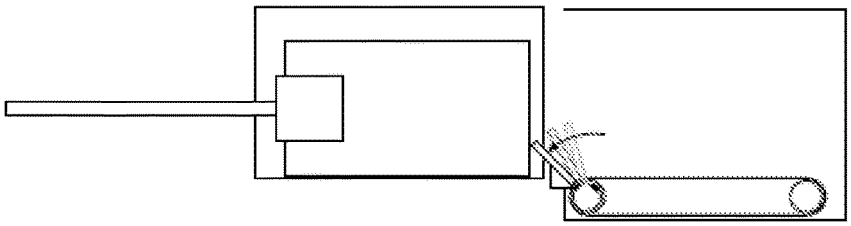

In FIG. 13C the bin is illustrated fully located upon the elevator's belt and ready for vertical transition towards an adjacent carousel or towards an outtake bin of a 'vertical' storing cabinet that includes such carousel. FIG. 13D schematically illustrates transition of a bin towards an 'operative' compartment here possibly implemented by belt biasing the bin via the rod to be urged towards the 'operative' compartment. FIG. 13E illustrates a final positioning of the bin within the 'operative' compartment.

Figure 14:
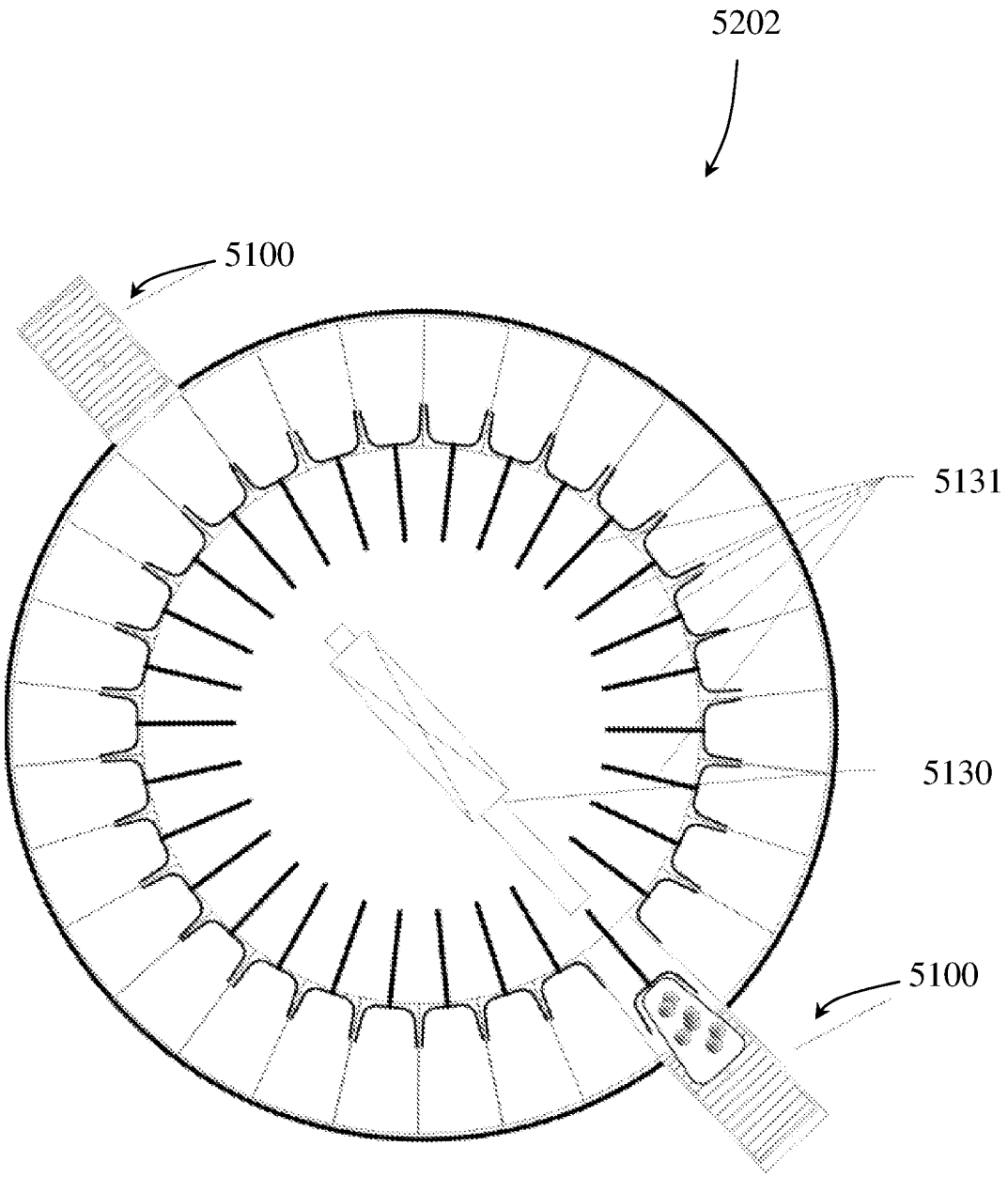

Attention is drawn to FIG. 14 illustrating a possible embodiment where a carousel 5202 generally similar to carousel 5200 includes more than one elevator 5100. Here two elevators 5100 may be provided to carousel 5202 consequently providing in carousel 5202 two 'operative' compartments through which items or bins may be discharged from or received into carousel 5202. Notably more than two, for example four, elevators may be provided resulting in additional 'operative' compartments (corresponding to the number of elevators) through which items or bins may be received or discharged from the carousels for example into or out of the cabinet and/or to different carousels within the cabinet.

Reference is now made to the flow diagram of FIG. 4 illustrating possible steps of an algorithm 1000 by which an item (or later discussed bin) may be stored and/or discharged into or from 'horizontal' or 'vertical' type storing cabinets of various embodiments of the invention.

In an embodiment, a system (possibly including a controller) may be provided to the cabinet and/or may be in communication therewith for example for facilitating such placing or removing of item(s) or bin(s) to or from storage within the cabinet.

In a first possible step 100 of the algorithm, the system may be started and/or initialized and in a subsequent possible step the system may inquire in question box 101 whether a new command has been received. If no new command has been identified, algorithm 1000 returns to re-check for incoming new commands in box 101. If receipt of a new command has been identified, the algorithm proceeds to question box 102 where an inquiry is made whether the new incoming command is for "intake" i.e. for receiving and storing an item (bin) within the cabinet.

If negative, the algorithm proceeds to question box 103 to inquire if the new incoming command is for "outtake" i.e. discharging an item (bin) out of the cabinet. If negative, the algorithm proceeds to step 104 to inquire whether the command is e.g. a house keeping command and then executes same if applicable and then returns to box 101 to keep re-checking for new in-coming commands.

A typical non-binding example of a house keeping command may include re-arranging items within compartments of the cabinet during "idle" periods of the system, so that items (or bins including items) may be more available for their expected use pattern. For example, the system may keep track of items (or bins) that are more frequently dispensed out of the cabinet and may re-arrange such items/bins in compartments closer to an outtake bin 16 of the cabinet. Such re-arranging may also be according to predefined criteria defining certain items as more "popular" and thus if possible arranged closer to the outtake bin.

If in question box 103 an "outtake" command is identified as affirmative, the algorithm may proceed to perform a series of steps 105 that may be required in order to discharge an item (bin) from the cabinet. These steps may include obtaining data from e.g. a database as to the source compartment where the item/bin to be discharged is stored (i.e. in which carousel and which compartment within the carousel is the 'to be' discharged stored item). The carousel including the source compartment may then be advanced to position the source compartment as the carousel's 'operative' compartment.

In a subsequent step, a discharge route out of the 'operative' compartment where the item is stored may be formed. This may be performed e.g. in a 'horizontal' type cabinet including carousels generally similar to carousel 52 or 520—by positioning empty compartments as the 'operative' compartments in all carousels below the source carousel where the item/bin to be discharged is stored. Then all shutters (in case of carousel 52) and/or doorways (in case of carousel 520) may be opened to provide an exit chute for the discharged article/bin. In a cabinet including carousels generally similar to carousel 5200 or 5202 such an exit path may be performed by discharging an item/bin from the 'operative' compartment to the elevator and from there to an outtake bin 16 of the cabinet.

In a 'vertical' type cabinet including carousels generally similar to carousel 202 a discharge route out of the 'operative' compartment may be provided by opening outtake shutter 214.

Returning to question box 102, if the incoming new command detected is "intake" then the algorithm proceeds to box 106 where gathering of possible tagged data on the item/bin is performed. The data from tag may then be stored in a database, such as database 108 illustrated in the flow chart or in another database not shown. In a subsequent step 107, a location within the cabinet where an empty compartment is located is retrieved from a database such as database 108.

In a 'horizontal' type cabinet the algorithm may then proceed to perform the steps illustrated within the 'dashed' enclosure in FIG. 4 to determine the carousel in which the item is to be stored and an intake route to this carousel. In a 'horizontal' type cabinet this accordingly may determine proceeding to box 109 where an inquiry is made whether the empty compartment for storing the item/bin is in the top carousel. If affirmative the algorithm proceeds to block 110 where the compartment in which the item is to be stored is positioned as a 'receiving' compartment under the entrance chute of the cabinet. In the shown embodiments (see, e.g., FIG. 2*a*) this means positioning this compartment also as the 'operative' compartment of the uppermost carousel. In embodiments including an elevator this may mean positioning the compartment where the item is to be stored radially adjacent and opposite the elevator.

If on the other hand, in block 109 it is determined that the destination compartment, in such 'horizontal' type cabinet, where the item is to be stored is in a lower carousel, then in the blocks tagged 111 all carousels above the destination carousel are positioned so that their 'operative' compartments are empty (and lower sides open) and in the destination carousel the compartment where storage of the item/bin is intended is positioned as this carousel's 'operative' compartment. Again, in embodiments including an elevator transition between carousels is made via the elevator.

Finally, in block 112 the intake trap door is opened and the item enters the destination compartment where it is to be stored; and from there the algorithm returns to block 101 to keep re-checking for new incoming commands.

In a 'vertical' type cabinet the algorithm may then proceed perform the steps illustrated within the 'dotted' enclosure in the lower side of FIG. 4 to determine the carousel in which the items is to be stored and an intake route to this carousel.

In a 'vertical' type cabinet this accordingly may determine proceeding to the sequence of steps tagged 1111 where first the compartment where the item is to be stored is made a 'receiving' compartment of its carousel. In a case of a 'vertical' cabinet having several carousels (or dividers defining effectively several carousels) such as in the cabinet shown in FIG. 7, this may determine positioning selector 304 so it provides an intake route to the correct carousel by turning it e.g. to provide a corresponding length leading to the carousel and/or in a cabinet including a carousel such as that illustrated in FIG. 6 this may determine by turning rotatable shutter 230 to allow an inserted item to be dropped into the correct carousel as indicated in possible step 1112.

As mentioned herein before, the item being stored in the system may preferably be sensed and can be identified by the cabinet's controller. Attention is drawn to FIG. 16 illustrating storing cabinets 1010 (here five such cabinets) according to at least certain embodiments of the invention, located in an urban environment, here optionally alongside a side-walk accessible to pedestrians/customers/service-personal.

The shown cabinets in this illustration exemplify possible use of such cabinets in addressing e.g. "last mile delivery" issues/challenges by being placed e.g. in urban centers, where on the one hand goods can be fed/inserted easily/efficiently therein by suppliers and/or postal service personal—while on the other hand customers can easily/efficiently obtain their goods.

Figure 16:
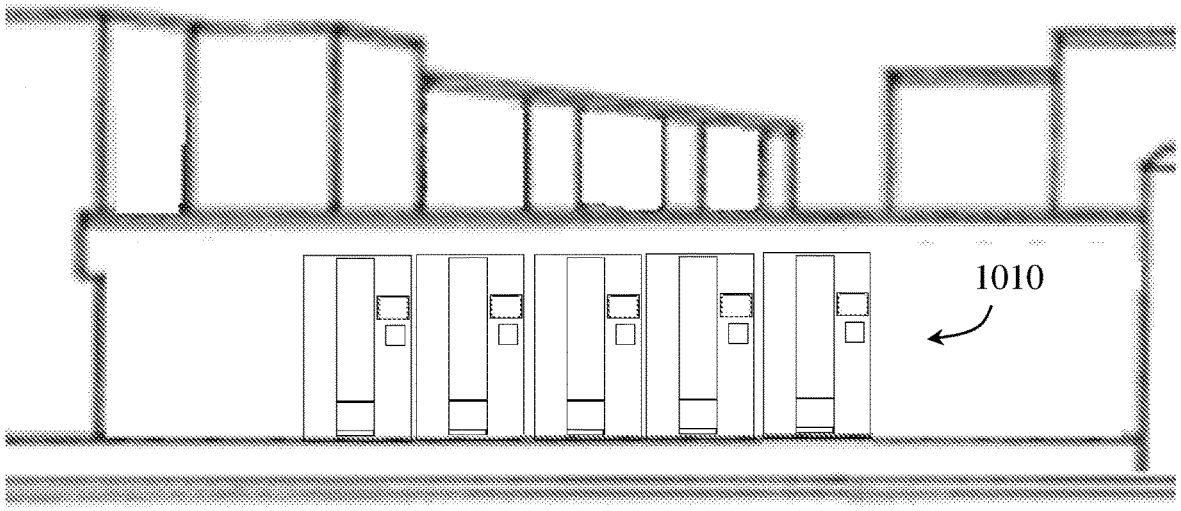
FIG. 16 Illustrates storing cabinets according to various embodiments of the invention located in an urban environment.
Figure 17A:
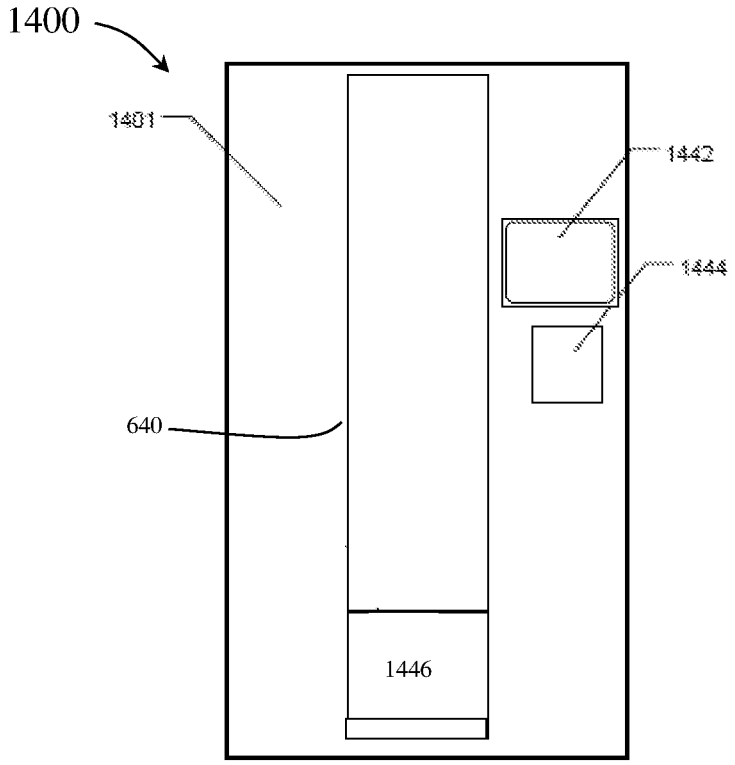
FIGS. 17A-D Illustrate a storing cabinet embodiment of the present invention FIG. 18 Illustrates a storing cabinet embodiment exemplifying an aspect possibly applicable to at least most embodiments of the invention of provision of stacked carousels with no shelves therebetween.
Figure 17B:
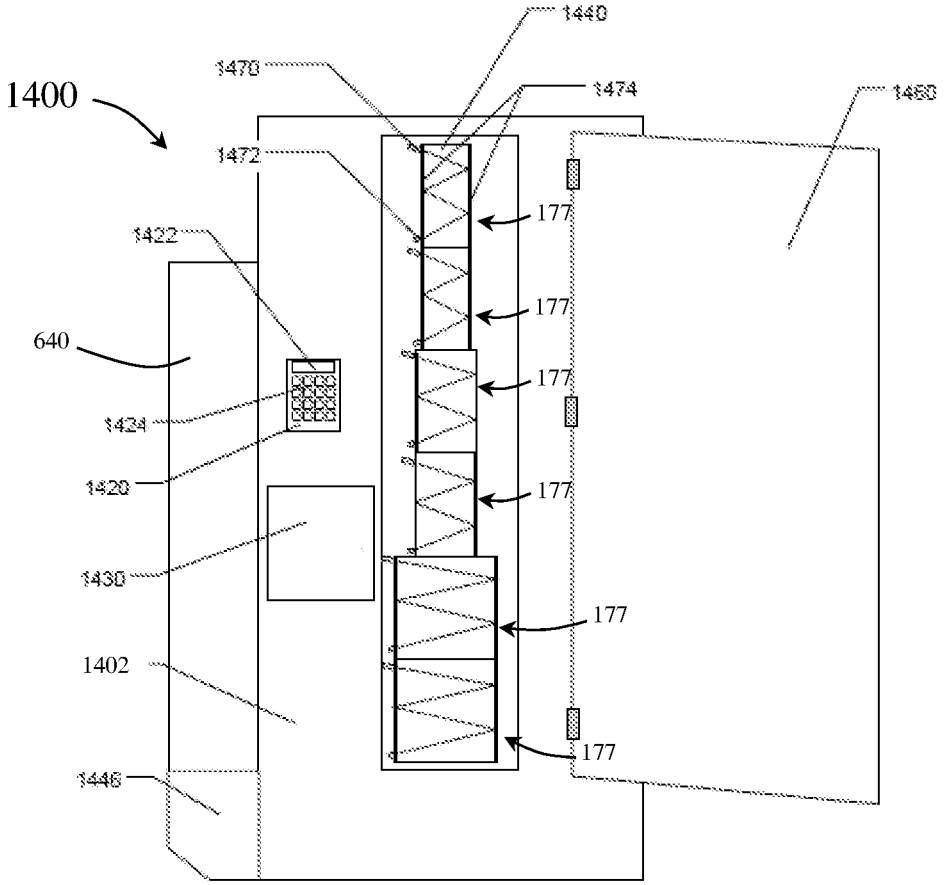
Figure 17C:
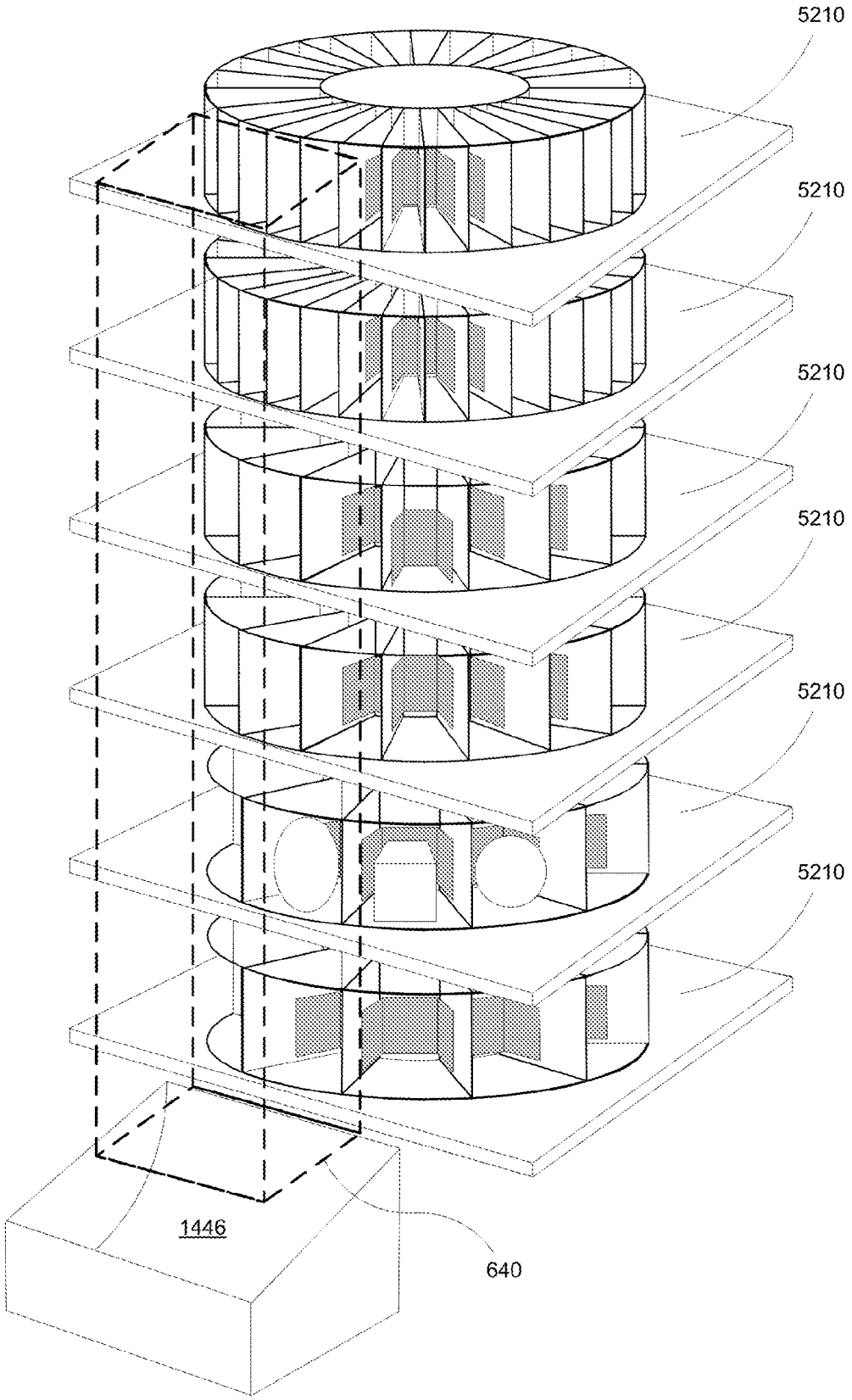
Figure 17D:
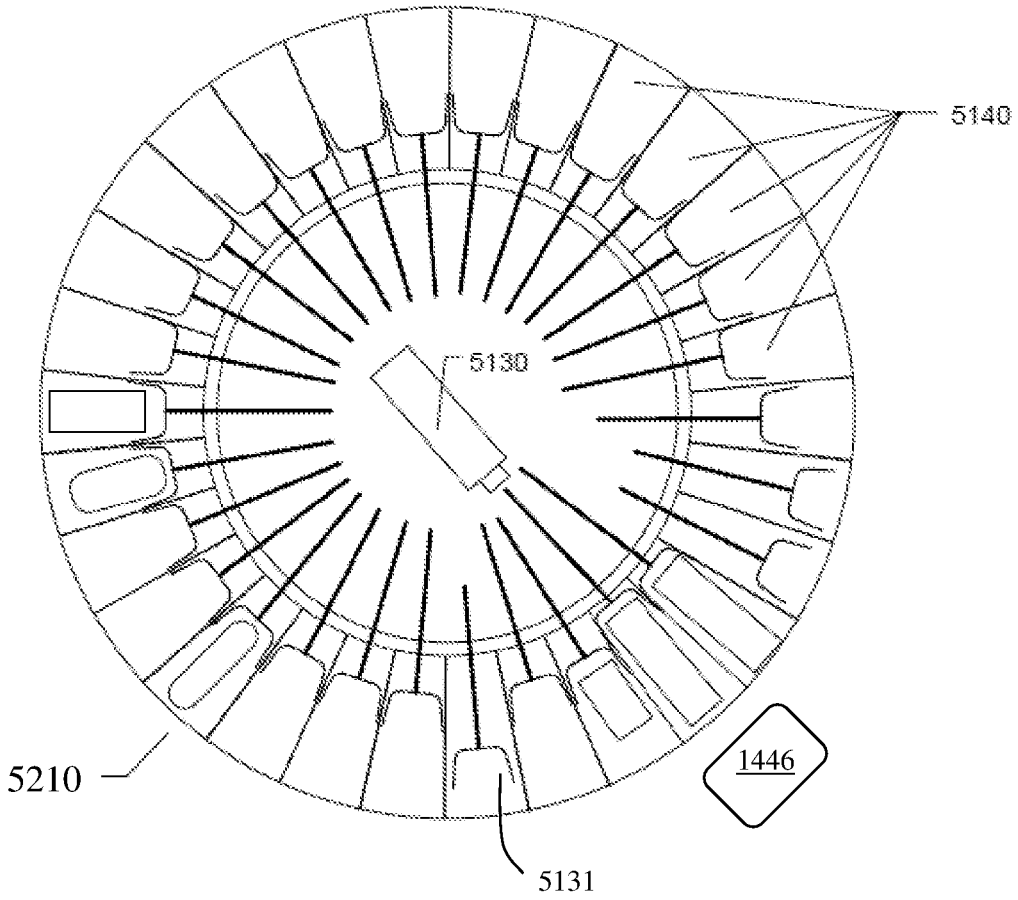

Attention is drawn to FIGS. 17A to 17D illustrating an embodiment of a storing cabinet 1400 possibly suitable for use, inter alia, in an urban setup such as the cabinet illustrated in FIG. 16. FIGS. 17A and 17B illustrate, respectively, front and lateral side views of the cabinet; and FIGS. 17C and 17D illustrate, respectively, perspective and top views of carousels 5210 stacked axially one on top of the other within the cabinet.

Storage cabinet 1400 includes several levels of axially spaced apart shelves, each containing/supporting a carrousel 5210. It is noted that the shelves may not necessarily be present in such cabinet and compartments in each carousel may be closed from their lower axial side instead. In the illustrated embodiment, each carousel 5210 includes generally equally sized compartments 5140 each opening out to a periphery of the carousel.

In an embodiment, compartment size may vary between different carousels so that each carousel may be arranged to house different sized packages/articles in its compartments. Compartment size between different carousels may be affected by varying parameters, such as compartment height in the axial direction, compartment width (or the like).

Cabinet 1400 in the shown example has a 'customer interface' side 1401 (see FIG. 17A) for delivery of articles to customers and/or for interaction with customers; and a 'fill up' side 1402 (see FIG. 17B) for inserting articles/packages into the cabinet. The 'fill up' side 1402 may be at an opposing rear side of the cabinet or at a lateral side of the cabinet as illustrated in FIG. 17B. In the shown embodiment, 'customer interface' side 1401 includes a reader 1444 for identifying/reading 'data' representative of an article/package to be retrieved by a customer from the cabinet.

In a non-binding example, reader 1444 may be a barcode reader and the 'data' representative of the article may be a barcode, QR-code (or the like) identifying the article/package to be retrieved. Such barcode may e.g. be displayable on a screen of a smart phone of the customer and reader 1444 by reading the barcode may identify the article to be extracted from the cabinet. In certain embodiments, specifying a package/article to be extracted from the cabinet may be via BLE link.

The 'customer interface' side 1401 in this example may also be provided with computing means 1442, such as a multi-purpose computer, tablet, personal computer (or the like) through which a customer may interact/communicate for defining an article to be retrieved from the cabinet (e.g. in case that the customer is not in possession of a smart phone or the like). In cases where a customer received more than one package/article delivery notification, 'data's' representative of the articles to be extracted may be fed to the cabinet for retrieving all of them.

Articles/packages extracted from the cabinet may be retrieved via an outtake bin 1446 possibly also available in the 'customer interface' side and accessible from an exterior of the cabinet. Cabinet 1400 in this example includes a straight chutelike passageway 640 located within the cabinet and concealed from cabinet's exterior. In FIGS. 17B & C the chutelike passageway 640 can be seen located radially outward and beyond carousels 5210 of cabinet 1400.

A compartment within each carousel 5210 that is rotated to a position aligned with passageway 640 becomes an 'operative' compartment of the carousel, and articles located within such compartment may be urged outwards to fall down via the chutelike passageway 640 into outtake bin 1446.

With attention drawn to FIG. 17D, each compartment 5140 within carousel 5210 is seen possibly provided with a fork 5131 located here at a radial inner side of its respective compartment and carousel 5210 may be provided with a pusher 5130 provided within the carousel that is configured upon activation to bear against a pushing fork associated with an 'operative' compartment of the carousel in order to urge articles within the 'operative' compartment to fall down via chutelike passageway 640 into outtake bin 1446.

A customer retrieving an article from cabinet 1400 providing identifying data relating to his/her article to be extracted, will urge the carousel housing his/her article to rotate until the compartment where the article is located becomes the 'operative' compartment of the carousel. By means of pusher 5130 bearing against fork 5131 of the 'operative' compartment, the customer's article may then be extracted out of the cabinet by being urged to fall down passageway 640 into outtake bin 1446. In at least certain embodiments, pusher 5130 may also be capable of pulling fork 5131 back after pushing the package out of the operative compartment.

'Fill up' side 1402 of the cabinet includes a door 1460, which when unlocked and opened permits access to all levels/carousels within cabinet 1400 for inserting packages/articles into the cabinet.

As seen in FIG. 17B, each given carousel may be accessed from 'fill up' side via an opening 177 generally corresponding in size (e.g. width/height) to the size of compartments within the given carousel.

Each opening 177 may include a detector (e.g. a laser diode 1470 and photo cell 1472) for detecting that an item has passed via the opening and is safely inserted into a compartment within a carousel. The detector may provide indication to a controller of the cabinet that an article has accordingly been placed in a compartment and/or that no obstruction exists (e.g. by part of an article bulging out of the opening)—since such obstruction if present may interfere e.g. in the turning of the carousel.

A detector including a possible diode 1470 may be arranged to emit a laser beam that bounces diagonally between two opposing mirrors 1474 to provide full coverage of each opening in order to make sure the system detects items being inserted into the cabinet.

A person (e.g. delivery person of an e-commerce company utilizing cabinet 1400) inserting articles into the cabinet may first identify each article via a barcode or RFID tag reader 1430. Interaction with the cabinet may also be via a panel 1420 provided with a keypad 1424 through which instructions/information can be delivered to a controller of the system and a display, preferably an LCD display 1422, through which a user receives data. In a subsequent step, he/she may select a suitable compartment for housing the article via selection of an appropriate opening 177 through which the article can pass. Inserting an article into a given compartment will urge the fork 5131 of the compartment backward thus possibly logging presence of the just identified article in the given compartment. Presence of the just identified article in the given compartment may also be provided via the detector.

If the article is removed for some reason from the given compartment, by e.g. the delivery person, in order e.g. to be inserted into another compartment/carousel, the system controlling the cabinet will log presence of the just identified article in the last compartment where it was placed.

The system may then communicate with a logistical software and/or database associated with the system and/or cabinet—the whereabouts of all articles inserted into the cabinet providing e.g. a specific ID of the compartment/carousel where each article was placed and possibly also further data such date/time, delivery person details (or the like). The logistical software may then communicate information of the entered articles that may in turn be communicated to clients awaiting delivery of their articles. The clients may be provided with exact location of the cabinet housing the article and further details permitting retrieval of the article out of the cabinet (e.g. barcode/QR-code info or the like).

Figure 18:
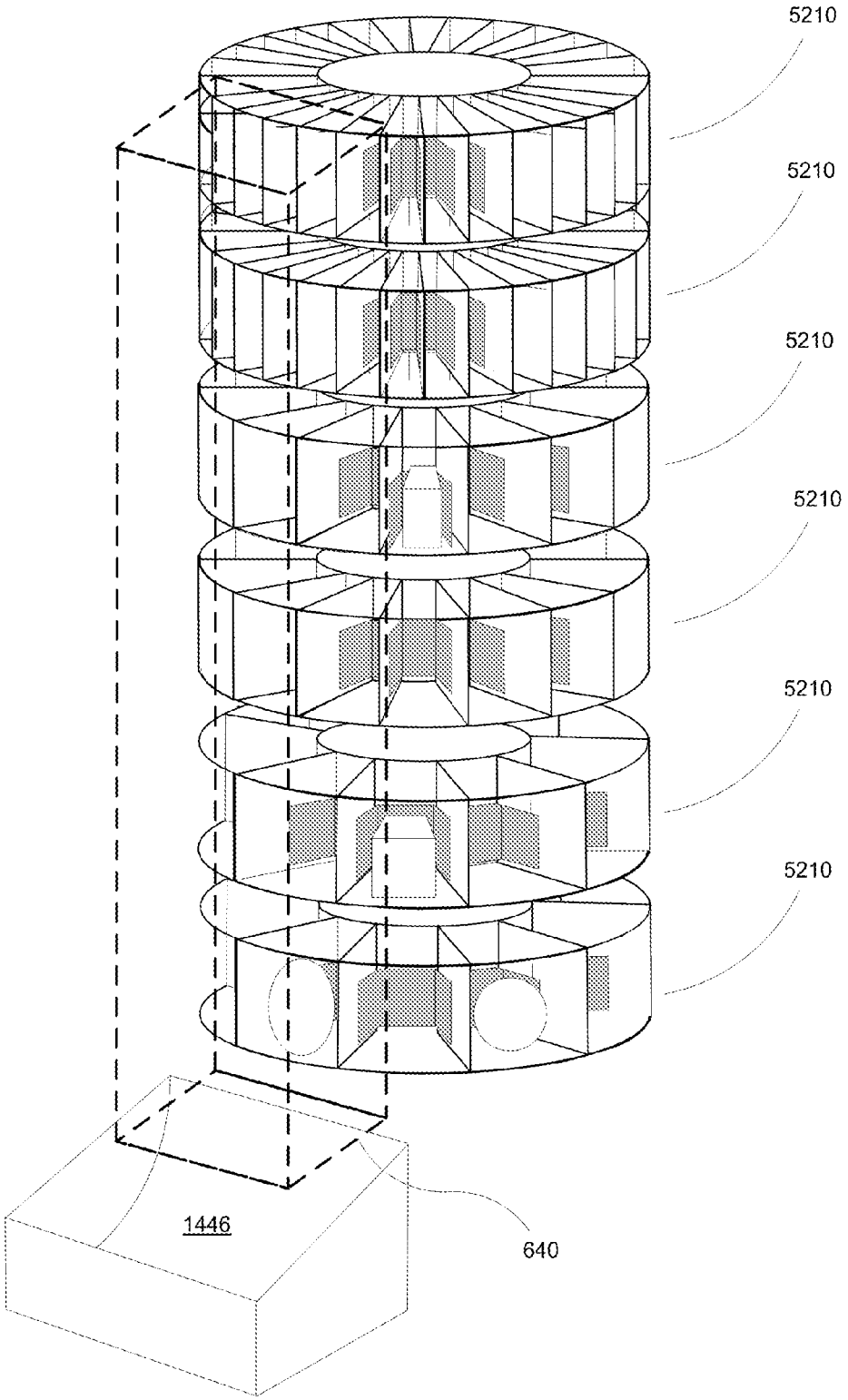

Multiple cabinets as illustrated in FIG. 16 may be placed in one location to form a delivery site that is arranged to handle distribution of large numbers of packages/articles to clients. Cabinets within a delivery site may be arranged to communicate with each other, e.g. in order to direct a customer providing identifying details of the article (or the like) to one of the cabinets in the delivery site—to the correct cabinet housing his article within the delivery site. Attention is drawn to FIG. 18 illustrating a storing cabinet embodiment possibly absent of shelves in-between adjacently stacked carousel layers. Such configuration may be applicable to at least most cabinet embodiments of the invention where carousel levels are absent of shelves therebetween, possibly rendering compartments within such carousels to be closed from their bottom side, possibly with integrally formed bottom sides.

Figure 19A:
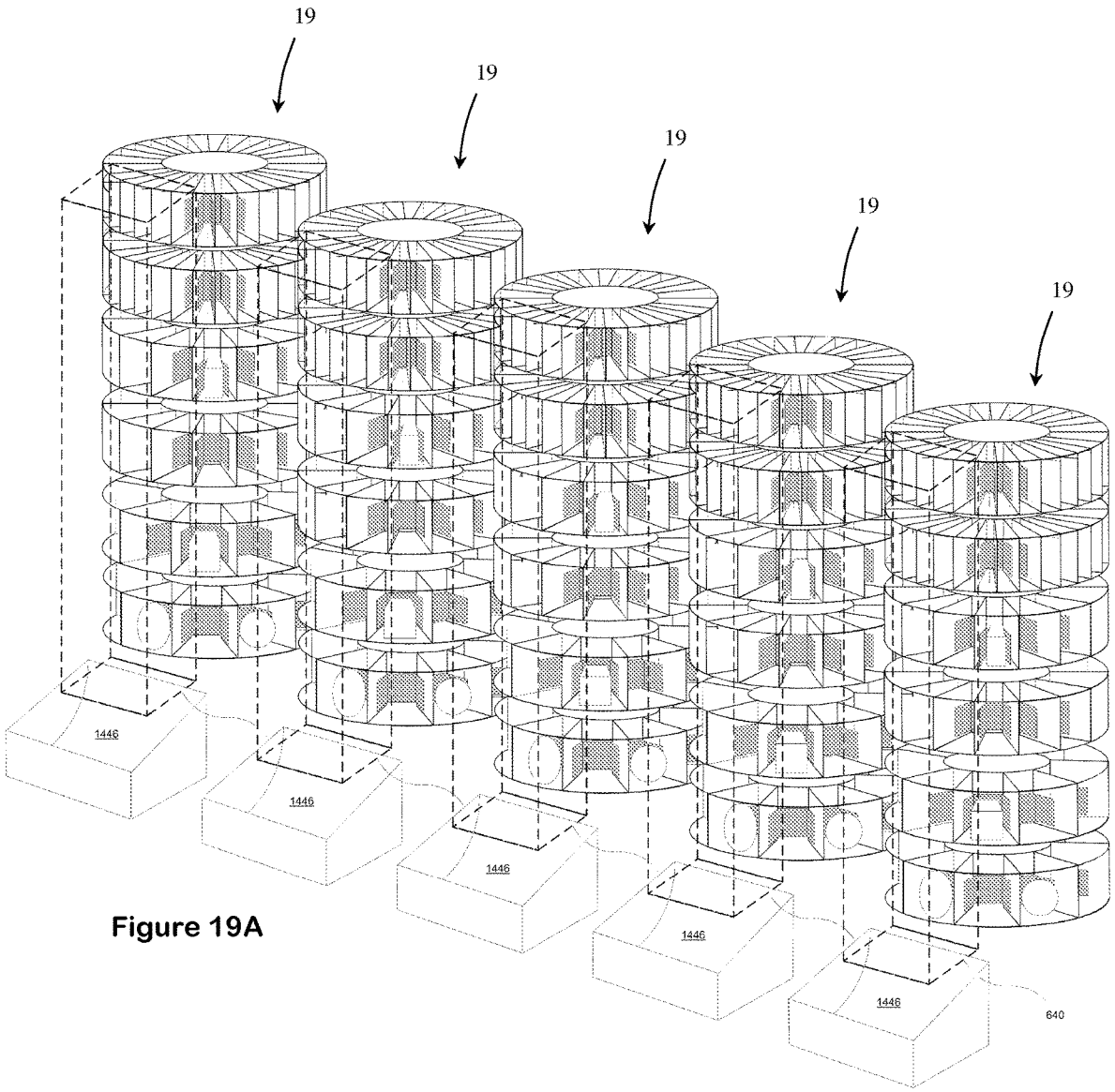
FIGS. 19A-B Illustrate an embodiment of the present invention exemplifying stacks of carousels forming carousel columns adjacently aside each other as part of a cabinet unit where communication of articles between carousel stacks/columns may be possible.
Figure 19B:
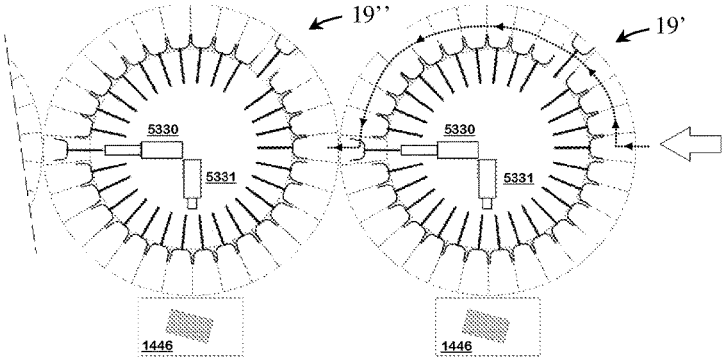

FIGS. 19A and 19B illustrate a cabinet-unit including a plurality of upright stacked carousels forming carousel columns 19 placed adjacently one aside the other. Such columns 19 may be arranged within a single housing (not shown) of such cabinet-unit to provide larger storage capacity of compartments for storing and/or distributing items/articles/parcels (and the like).

Insertion of items may be from a single 'fill up' side (such as 'fill up' side 1402 in FIG. 17B). FIG. 19B illustrates a top view of such a multiple column cabinet unit, here fully showing two carousel columns 19', 19" from above and a "fill up" side illustrated by the arrow at the right-hand side of this figure. Such cabinet-unit may be arranged to laterally/horizontally distribute items between compartments of carousels located in different columns 19', 19" (etc).

One option of distributing items between carousel columns may be clarified in the following example, illustrating insertion of an item into a compartment of the upper most carousel of the right column 19'. The item may be stored in this carousel until it is retrieved from the carousel via the outtake bin 1446 associated with this carousel or column.

Alternatively, or in addition; the item may be distributed onwards to the carousel/column where it is intended to be stored, for example to a carousel/compartment within column 19" (to its left) or to carousel/columns further away, by being temporarily stored in a compartment in column 19".

A carousel within column 19' receiving in a given compartment an item at the cabinet-unit's "fill up" side; may be urged to rotate to place the given compartment adjacent a neighboring compartment within a carousel of column 19". In the illustrated example, this may include rotating the carousel in column 19' by 180 degrees.

Once rotated, a distributing pusher 5330 provided within the carousel may urge the discussed item out of the compartment and into a compartment within the neighboring carousel in column 19". The 'dotted arrowed line' in FIG. 19B illustrates the discussed route that an item may pass from the cabinet-unit's 'fill up' side through a carousel within column 19' towards a compartment within a carousel in column 19".

This process of transferring/distributing the item between columns may continue until the item reaches the column/carousel where it is intended to be stored. As seen, each carousel may also be provided with an additional pusher 5331 for pushing items out of an 'operative' compartment' of the carousel towards an outtake bin 1446 possibly available at a 'customer interface' side of the cabinet unit.

Figure 20:
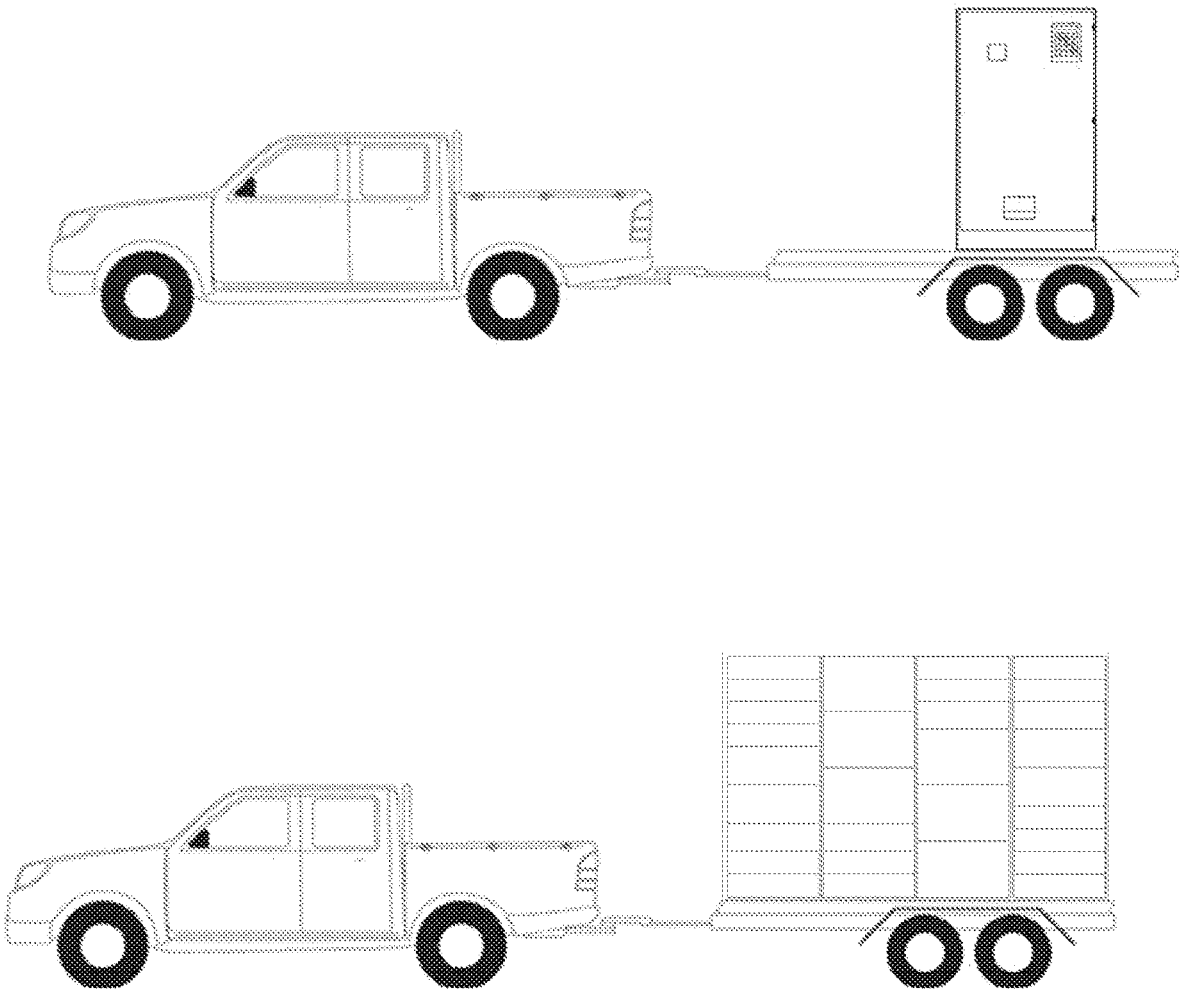
FIG. 20 Illustrates embodiments of the present invention of transportable and/or movable storing cabinet(s) and/or method for utilizing same.

Attention is drawn to FIG. 20 illustrating an aspect of the invention where storing cabinet embodiments may be arranged to be transportable. In this example, at the upper side of FIG. 20 a single storing cabinet is seen being configured for transport (here by being placed on a trailer) however as illustrated below more than one cabinet may used. It is noted that storing cabinets used in such transportable mode may be similar to those described herein above or also of different configurations suitable for storing and distributing items.

In an aspect of the invention, provision of such transportable cabinet(s) may be useful in assisting in conveniently distributing items to customers, by bringing the cabinet(s) to locations possibly more easily accessible to clients.

In one example, a service for distributing items (e.g. postal parcels) to customers may include transmission/communicating of notifications to clients who's items are stored in such cabinet(s)—as to the expected whereabouts of the cabinet(s) including expected time that the cabinet will be at a given location and possibly the start and end time of presence in such location. Possibly, provision of a route of the transportable cabinet(s) including time and duration of presence in each location along the route may be transmitted/communicated to customers, possibly in advance, so that customers expecting to receive items within such cabinet(s) may plan ahead their preferred pickup location. Items being picked up may be removed from a notification list so that only clients who's items are still within the cabinet(s) may continue to receive notifications.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Further more, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures can not be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A cabinet unit comprising a plurality of upright extending carousel columns placed one aside the other, each carousel column comprising a plurality of carousels stacked one above the other and each carousel being rotatable about an upright extending axis of the column, each carousel comprising a plurality of compartments formed about the axis, wherein the cabinet unit is configured to store items into the compartments or discharge items out of the compartments, wherein the cabinet unit comprising a fill up side where items can be inserted into one or more compartments within a given carousel column, and wherein an item inserted into the cabinet unit via the fill up side can be transferred onwards to be stored in a compartment within another carousel column.

2. The cabinet unit of claim 1, wherein transferring an item onwards to be stored in another carousel column comprises rotating a carousel storing the item to position the compartment with the item adjacent an empty compartment in an adjacent carousel column, wherein preferably transferring the item into the empty compartment comprises pushing it out of the compartment where it is located and into the empty compartment.

3. The cabinet unit of claim 2, wherein discharging of items is arranged to be out of each carousel column.

4. The cabinet unit of claim 1, wherein discharging an item to be removed out of a carousel column is without need to remove and discharge out of the column other stored items in its removal path.

5. The cabinet unit of claim 1 and defining for each given carousel within a carousel column a portal sector at a fixed angular position about the axis and the given carousel is configured to rotate about the axis to position different compartments in alignment with the portal sector, and each compartment rotated into such alignment becomes an operative compartment of the carousel through which items can be discharged out of the carousel, wherein possibly for each given carousel more than one portal sector and respectively more than one operative compartment being defined.

6. The cabinet unit of claim 4, wherein discharging of items is through an opening that is formed via which an interior of an operative compartment can be in communication with its exterior.

7. The cabinet unit of claim 6, wherein discharging of items is in a radial outward direction.

8. The cabinet unit of claim 5, wherein discharging an item from an operative compartment of an upper carousel is into a compartment of a lower carousel located beneath.

9. The cabinet unit of claim 8, wherein operative compartments of all the carousels are located axially one on top of the other.

10. The cabinet unit of claim 5 and comprising a chutelike passageway located radially beyond the carousels and discharging an item out of an operative compartment comprises dropping it down the chutelike passageway.

11. A method of operating a cabinet unit for storing and/or discharging items comprising the steps of:

providing a cabinet unit comprising a plurality of upright extending carousel columns placed one aside the other, each carousel column comprising a plurality of carousels stacked one above the other and each carousel being rotatable about an upright extending axis of the column and comprising a plurality of compartments formed about the axis, wherein the cabinet unit is configured to store items into the compartments or discharge items out of the compartments, providing a fill up side for the cabinet unit where items can be inserted into one or more compartments within a given carousel column, and wherein an item inserted into the cabinet unit via the fill up side can be transferred onwards to be stored in a compartment within another carousel column.

12. The method of claim 11, wherein transferring an item onwards to be stored in another carousel column comprises rotating a carousel storing the item to position the compartment with the item adjacent an empty compartment in an adjacent carousel column, wherein preferably transferring the item into the empty compartment comprises pushing it out of the compartment where it is located and into the empty compartment.

13. The method of claim 11, wherein discharging of items is arranged to be out of each carousel column.

14. The method of claim 11, wherein discharging an item to be removed out of a carousel column is without need to remove and discharge out of the column other stored items in its removal path.

15. The method of claim 11 and defining for each given carousel within a carousel column a portal sector at a fixed angular position about the axis and the given carousel is configured to rotate about the axis to position different compartments in alignment with the portal sector, and each compartment rotated into such alignment becomes an operative compartment of the carousel through which items can be discharged out of the carousel, wherein possibly for each given carousel more than one portal sector and respectively more than one operative compartment being defined.

16. The method of claim 15, wherein discharging of items is through an opening that is formed via which an interior of an operative compartment can be in communication with its exterior.

17. The method claim 16, wherein discharging of items is in a radial outward direction.

18. The method of claim 17, wherein discharging an item from an operative compartment of an upper carousel is into a compartment of a lower carousel located beneath.

19. The method of claim 15, wherein operative compartments of all the carousels are located axially one on top of the other.

20. The method of claim 19 and comprising a chutelike passageway located radially beyond the carousels and discharging an item out of an operative compartment comprises dropping it down the chutelike passageway.

* * * * *